US007342190B2

(12) United States Patent
Burgess et al.

(10) Patent No.: US 7,342,190 B2
(45) **Date of Patent: *Mar. 11, 2008**

(54) PRESSURE ACTUATED SWITCHING DEVICE AND METHOD AND SYSTEM FOR MAKING SAME

(76) Inventors: Lester E. Burgess, Box 522, Swarthmore, PA (US) 19081; Richard Lerch, 23 War Admiral La., Media, PA (US) 19063

( * ) Notice: Subject to any disclaimer, the term of this patent is extended or adjusted under 35 U.S.C. 154(b) by 0 days.

This patent is subject to a terminal disclaimer.

(21) Appl. No.: 11/513,887

(22) Filed: Aug. 31, 2006

(65) Prior Publication Data

US 2007/0068787 A1 Mar. 29, 2007

Related U.S. Application Data

(60) Continuation of application No. 10/760,655, filed on Jan. 17, 2004, now Pat. No. 7,102,089, which is a division of application No. 10/227,963, filed on Aug. 26, 2002, now Pat. No. 6,689,970.

(60) Provisional application No. 60/326,968, filed on Oct. 4, 2001.

(51) Int. Cl.
*H01H 3/16* (2006.01)

(52) U.S. Cl. ..... 200/61.43; 200/61.25

(58) Field of Classification Search ..... 200/61.25, 200/85 A, 61.43, 6 R, 512–520, 86 A, 61.62, 200/262–270

See application file for complete search history.

(56) References Cited

U.S. PATENT DOCUMENTS 2,138,549 A * 11/1938 La Bell ..... 200/86 R
2,163,960 A * 6/1939 Paver ..... 200/86 R
3,277,256 A * 10/1966 Jones ..... 200/61.43
3,868,000 A * 2/1975 Spear et al. ..... 187/317
4,066,851 A * 1/1978 White et al. ..... 200/5 A
4,684,768 A * 8/1987 Sackmann et al. ..... 200/61.43
5,728,983 A * 3/1998 Ishihara et al. ..... 200/61.43
6,396,010 B1 * 5/2002 Woodward et al. ..... 200/61.43
6,437,263 B1 * 8/2002 Burgess et al. ..... 200/61.43
6,482,335 B1 * 11/2002 Greene ..... 252/511
6,483,054 B2 * 11/2002 Suzuki et al. ..... 200/61.44
6,584,678 B2 * 7/2003 Burgess et al. ..... 29/622

* cited by examiner

*Primary Examiner*—Michael A Friedhofer
*Assistant Examiner*—Lisa Klaus
(74) *Attorney, Agent, or Firm*—Dilworth & Barrese, LLP

(57) ABSTRACT

A pressure actuated switching device is made by applying at least a first layer of fluid conductive polymeric coating material to a surface of a sheet of green rubber material. The conductive polymeric coating is solidified to form an electrode, and the sheet of green rubber material is vulcanized. Two strips of green rubber may be simultaneously processed and then joined such that the respective layers of conductive coating are in spaced apart opposing relationship. The conductive polymeric coating may optionally be formulated with green rubber. Optionally, a blowing agent may be included in the conductive coating formulation so as to provide a cellular polymeric foam piezoresistive material from which the electrode is constructed. The green rubber sheets may be processed by a continuous rotary method or by a linear method using a clamping press having opening and closing dies for heating and joining the strips of green rubber.

10 Claims, 23 Drawing Sheets

PRESSURE ACTUATED SWITCHING DEVICE AND METHOD AND SYSTEM FOR MAKING SAME

CROSS-REFERENCE TO RELATED APPLICATIONS

This application is a continuation of U.S. patent application Ser. No. 10/760,655 filed Jan. 17, 2004, now U.S. Pat. No. 7,102,089 which is a divisional of U.S. application Ser. No. 10/227,963 filed on Aug. 26, 2002 and now issued as U.S. Pat. No. 6,689,970, which claims priority to U.S. provisional application Ser. No. 60/326,968 filed Oct. 4, 2001, which is herein incorporated by reference in its entirety.

BACKGROUND

1. Field of the Disclosure

The present invention relates to a pressure actuated switching device and a system and method for making it. It especially relates to the use of green rubber to fabricate a tubular sensor with a highly conductive elastomer coating within the channel of the sensor.

2. Description of the Related Art

Pressure actuated switching devices are known in the art. Typically, such devices include two spaced apart conductive layers enveloped in an insulative outer cover. Optionally, the conductive layers may be separated by an insulative spacer element, or "standoff." Also, the pressure actuated switching device can optionally include a piezoresistive material. The electrical resistance of a piezoresistive material decreases in relation to the amount of pressure applied to it. Piezoresistive materials provide the pressure actuated switching device with an analog function which not only detects the presence of a threshold amount of applied force but also provides a measure of its magnitude. Pressure actuated switching devices can be used as mat switches, drape sensors, safety sensing edges for motorized doors, and the like.

U.S. Pat. Nos. 6,121,869 and 6,114,645 to Burgess disclose a pressure activated switching device which includes an electrically insulative standoff positioned between two conductive layers. The standoff is preferably a polymeric or rubber foam configured in the form of contoured shapes having interdigitated lateral projections. Optionally the switching device can include a piezoresistive material positioned between a conductive layer and the standoff.

U.S. Pat. No. 5,856,644 to Burgess discloses a freely hanging drape sensor which can distinguish between weak and strong activation of the sensor. The drape sensor includes a piezoresistive cellular material and a standoff layer. The drape sensor can be used in conjunction with moving objects such as motorized doors to provide a safety sensing edge for the door. Alternatively, the drape sensor can be used as a freely hanging curtain to detect objects moving into contact therewith.

U.S. Pat. Nos. 5,695,859, 5,886,615, 5,910,355, 5,962,118 and 6,072,130, all to Burgess, disclose various embodiments of pressure activated switching devices.

There is a special need for a narrow channel tubular sensor switch to serve as a backup obstacle detector on the lift gate, or rear hatch, of automotive vans or mini-vans. This backup obstacle detection device is preferably in the form of a seal type touch strip attached to the vehicle body or door panel, where the door closure will create a small area that could trap objects as the door is closing. For example, lift gates or rear hatches which close with a scissors-like action create very small spaces where the door moves toward the body.

As demand grows for lower cost high performance elongated narrow channel tubular pressure actuated switches, it becomes increasingly advantageous to fabricate these devices from high functioning rubber materials and to have more efficient and more flexible related methods of production. For example, it may be preferable to have one or more components fabricated more efficiently at one facility or operation, then shipped to another facility or operation for further processing and/or assembly. These and other advantages are provided by the system and method for making a high quality simplified rubber pressure actuated switching tubular device as described below. The desired narrow channeled tubular sensor meets the rigid all weather requirements of the transportation and other industries.

It is an object of this invention to create an inexpensive, but high performing narrow elongated channel tubular sensor switch and system and method of manufacturing the switch. A further object of the present invention is to provide several variations of tubular sensor configurations with related methods of manufacturing designed for a variety of applications.

SUMMARY

The object of the present invention is achieved, in broad terms, providing an elastomer or rubber tubular shaped switch form, through special processing from green rubber, to effect a housed, vulcanized, integrated conductive coated electrode, switch sensor. Several variations of high quality tubular sensor configurations and related systems and methods for making a pressure actuated switching device is provided herein. The system includes the steps of: (a) providing at least a first strip sheet of green rubber material; (b) applying at least a first layer of fluid conductive green rubber polymeric coating material to at least a portion of a surface of the first strip sheet of green rubber material; (c) drying or solidifying the first conductive polymeric coating; and, (d) providing at least a second strip sheet of green rubber material; (e) applying at least a first layer of fluid conductive green rubber polymeric coating material to at least a portion of a surface of the second strip sheet of green rubber material; (f) drying or solidifying the first conductive polymeric coating; and, (g) elongated channel forming of the first coated layer of green rubber (coating facing outward); (h) with second layer of green rubber (coating facing inward) mating to merge pinch the edges together; (i) vulcanizing the mated sheets of green rubber material to form a cross-linked elastomeric tubular substrate.

BRIEF DESCRIPTION OF THE DRAWINGS

Various embodiments are described below with reference to the drawings wherein.

DETAILED DESCRIPTION OF PREFERRED EMBODIMENT(S)

Figure 1:
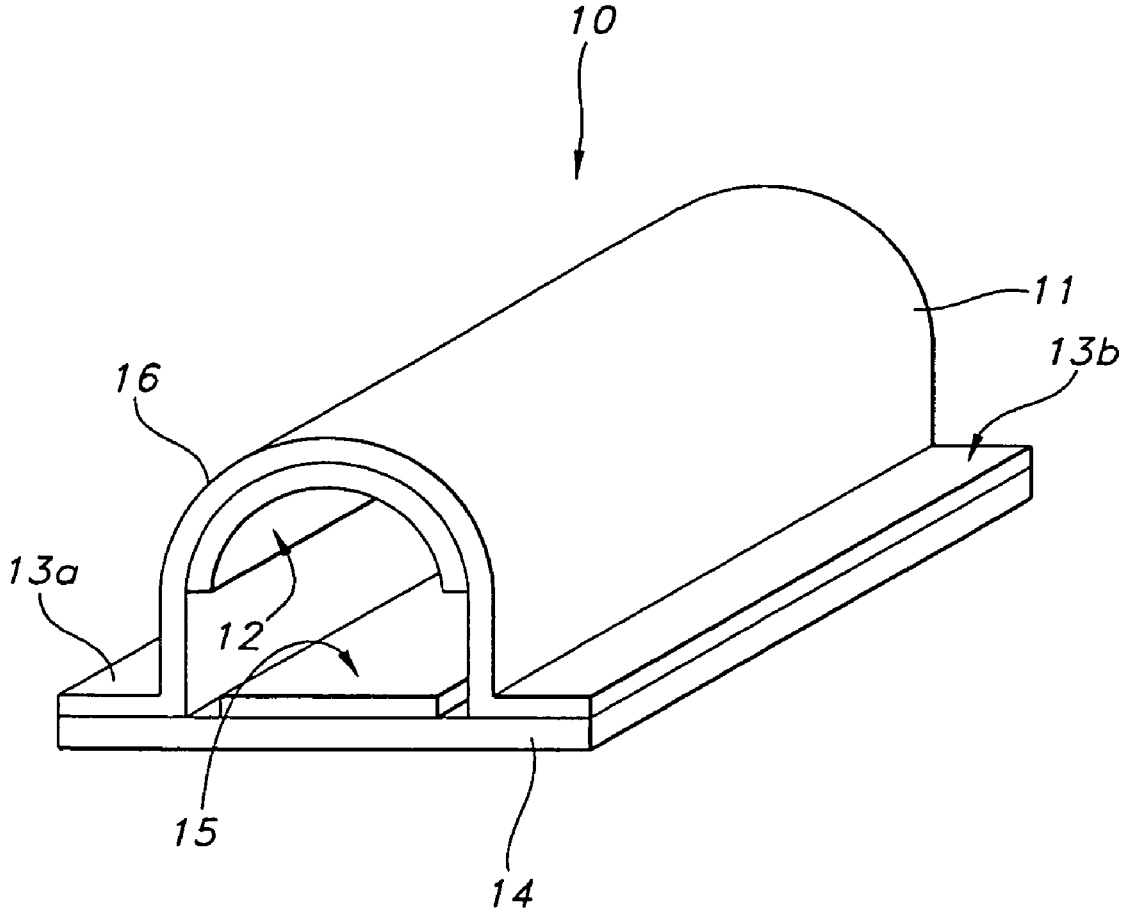
FIG. 1 is a perspective view of a tubular sensor.

As used herein the terms "conductive", "resistance", "insulative" and their related forms, pertain to the electrical properties of the materials described, unless indicated otherwise. The terms "top", "bottom", "upper", "lower" and like terms are used relative to each other. The terms "elastomer" and "elastomeric" are used herein to refer to a material that can undergo at least about 10% deformation elastically. Typically, elastomeric materials suitable for the purposes described herein include polymeric materials such as plasticized polyvinyl chloride, thermoplastic polyurethane, and natural and synthetic rubbers and the like. A pertinent rubber technology term is Mooney Viscosity. Mooney Viscosity is a measure of the viscosity of a rubber or a rubber compound in a heated Mooney shearing disc viscometer. As used herein, the term "piezoresistive" refers to a material having an electrical resistance which decreases in response to compression caused by mechanical pressure applied thereto in the direction of the current path. Such piezoresistive materials typically include resilient cellular polymers foams with conductive coatings covering the walls of the cells. Composition percentages are by weight unless specified otherwise. Except for the claims all quantities are modified by the term "about".

"Resistance" refers to the opposition of the material to the flow of electric current along the current path and is measured in ohms. Resistance increases in proportion to the length of the current path and the specific resistance, or "resistivity", of the material, and it varies inversely to the amount of cross-sectional area available the current path. The resistivity is a property of the material and may be thought of as a measure of (resistance/length)×area. More particularly, the resistance may be determined in accordance with the following formula:

$$R=(\rho L)/A \quad \text{(I)}$$

wherein R=resistance in ohms

ρ=resistivity in ohm-inches

L=length in inches

A=area in square inches.

The current through a circuit varies in proportion to the applied voltage and inversely with the resistance as provided by Ohm's Law:

$$I=V/R \quad \text{(II)}$$

wherein I=current in amperes

V=voltage in volts

R=resistance in ohms.

Typically, the resistance of a flat conductive sheet across the plane of the sheet, i.e., from one edge to the opposite edge, is measured in units of ohms per square. For any given thickness of the conductive sheet, the resistance value across the square remains the same no matter what the size of the square is. In applications where the current path is from one surface to another, i.e., in a direction perpendicular to the plane of the sheet, resistance is measured in ohms.

The pressure actuated switching device described herein is preferably an elongated tubular type sensor switch. The tubular sensor includes a resilient elastomeric outer non-conductive housing, and at least two spaced apart conductive electrode layers disposed in the inner surfaces of the housing. When a mechanical force of sufficient magnitude is applied to the tubular sensor, the housing collapses such that the spaced apart conductive electrode layers come into contact with each other, thereby closing the switch. The tubular sensor is sensitive, not only to vertically applied force, but also lateral or angular force.

A significant feature of the present invention is the use of green rubber. The term "green rubber" refers to a thermoset elastomeric polymer rubber stock or compound, in some form, which has not been vulcanized or cured. The "green strength" of the rubber stock is the resistance to deformation of the rubber stock in the uncured, or only partially cured, green state. In the green state the polymer can be injection molded, extruded, and otherwise formed into various shapes. The green rubber can be provided in the form of sheets which can be processed at room temperature by calendering, rolling, pinching, laminating, and embossing, etc., and can be coated and shaped into various configurations. The green rubber can be vulcanized by heating it to a temperature at which the molecular structure undergoes cross-linking. Vulcanization increases the elasticity of the rubber stock but renders the rubber less plastic. Typically, green rubber can be cured at from about 300° F. to about 400° F. for about 10 minutes to 60 minutes. A green compounded rubber suitable for use in the present invention is based on ethylene-propylene-diene monomer (i.e., "EPDM") formulations, and is commercially available in sheet form from various suppliers such as Salem Republic Rubber Company of Sebring, Ohio. Salem Republic Rubber Company's sheet compound, SRR EPDM #365-0, is preferable because of its high Mooney Viscosity. Cold or warm formed configurations made from sheet prepared with lower viscosity compounds lose their shape during vulcanizing. Because of the tackiness of rubber in the green state, a release sheet having a non-stick surface such as coated release paper, polyethylene film, or other such non-stick sheet, is generally co-wound with the green rubber, serving as a release interface, to prevent the rubber from sticking to itself.

Referring now to FIG. 1, an elongated tubular sensor type of pressure actuated switching device 10 is illustrated wherein the housing includes a cover substrate 11 and a base substrate 14. Cover substrate 11 includes a curved upper portion 16 and a lateral flange portions 13*a* and 13*b* extending along each of two opposite sides. A conductive electrode coating 12 is deposited on the interior surface of the cover substrate at the curved upper portion 16. The base substrate 14 is an elongated flat member having a conductive electrode coating 15 applied to the upper surface. The cover substrate 11 and base substrate 14 are hermetically sealed along flange portions 13*a* and 13*b* by any suitable means such as adhesive bonding, heat seal bonding, etc. The preferred method for assembly includes the use of green rubber for fabricating cover substrate 11 and base substrate 14. After assembling and positioning the components of the switching device 10 flanges 13*a* and 13*b* are pressed against the respective area of the base substrate 14, thus merging the rubber together in these areas. Subsequent vulcanization produces a chemically linked bond in the merged areas. Cover substrate 11 is fabricated from a flexible and resilient material such that pressure applied to the top surface of the cover substrate 11 causes the cover substrate to resiliently deform so as to bring the upper conductive electrode coating 12 into contact with lower conductive electrode coating 15, thereby making electrical contact and closing the switch. Base substrate 14 can be mounted, for example, to a panel, to a floor or to the edge of a movable door such as a garage door, rotating door, etc.

The conductive coating, which serves as an electrode in the pressure actuated switching device, is preferably applied to the substrate as a fluid and then dried. A preferred composition for the conductive coating material includes a binder such as a polymeric resin (especially preferred is a green rubber resin), a conductive filler such as a particulate metal (e.g., a fine powder and/or fibers of: copper, silver coated copper, silver, gold, zinc, aluminum, nickel, silver coated copper, silver coated glass, silver coated aluminum), graphite powder, graphite fibers, carbon fibers, or carbon powder (e.g., carbon black), and optionally a diluent or solvent. The solvent can include organic compounds, either individually or in combination, such as ketones (e.g., methylethyl ketone, diethyl ketone, acetone), ethers (e.g., tetrahydrofuran), esters, (e.g., butyl acetate), alcohols (e.g., isopropanol), hydrocarbons (e.g., naphtha, xylene, toluene, hexane, octane), or any other liquid capable of dissolving the selected binder. Cross-linking agents and other chemicals are used to facilitate curing or vulcanization. Plasticizer, and other additives are used to affect the properties of the cured coating. A suitable composition for a green rubber based conductive coating is set forth below in Table I. Water can be used as a diluent for aqueous systems. Exemplary formulations for the conductive coating material are also given below in Tables II and III:

TABLE I

| Organic Solvent System (Composition in parts by weight) | Broad Range | Preferred Range |
|---|---|---|
| Binder | | |
| EPDM green rubber (20% solids in toluene) | 1-5 | 2-4 |
| Conductive Filler | | |
| Silver pigment | 5-9 | 6-8 |
| Solvent | | |
| Toluene | 20-300 | 100 |

TABLE II

| Organic Solvent System (Composition in parts by weight) | Broad Range | Preferred Range |
|---|---|---|
| Binder | | |
| Silicon Rubber Resin elastomeric resin (20% solids in toluene) | 1-5 | 2-4 |
| Conductive Filler | | |
| Silver pigment | 5-9 | 6-8 |
| Diluent | | |
| toluene | 20-300 | 100 |

TABLE III

| Aqueous System (Composition in parts by weight) | Broad Range | Preferred Range |
|---|---|---|
| Binder | | |
| Silicon Rubber elastomeric resin (40% solids in an aqueous emulsion or latex) | 2-10.7 | 4-8 |

TABLE III-continued

| Aqueous System (Composition in parts by weight) | | |
|---|---|---|
| | Broad Range | Preferred Range |
| Conductive Filler | | |
| Silver pigment | 5-9 | 6-8 |
| Diluent | | |
| Deionized water (with surfactant) | 20-300 | 30-100 |

The formulation can be modified by selecting other component materials or composition amounts to accommodate different substrate materials or conditions of operation. For example, a significant advantage can be achieved by employing green rubber as the binder.

Moreover, a graphite fiber formulated green rubber based conductive coating material can also include from about 1 parts to about 12 parts of a blowing agent such as dinitrosopentamethylene tetraamine (DNPT). The addition of the blowing agent will cause the conductive coating material to form a foamed piezoresistive coating having an open-celled or closed-celled structure depending on the amount of blowing agent in the composition. In this closed cell embodiment, the conductive electrode coating or expanded conductive raised portion can be what is herein referred to as an "intrinsically conductive foam".

Intrinsically conductive foam includes an expanded cellular elastomeric polymeric or rubber foam matrix having embedded therein a conductive filler including conductive powder and conductive fibers, and which has an electrical resistance which decreases in response to compression caused by mechanical pressure applied thereto. An intrinsically conductive piezoresistive material is disclosed in U.S. Pat. No. 5,962,118, which is herein incorporated by reference in its entirety. Most preferred is an intrinsically conductive piezoresistive material having a foam rubber matrix, and a conductive filler including both conductive powder and conductive fibers selected from those materials mentioned above. Most preferred are powders of silver and/or carbon black, and fibers of silver and or graphite. Typically, the graphite particle size (diameter) of the conductive powder ranges from about 50 micrometer to about 100 micrometers. The carbon particle size from 8 to 30 nanometers. The silver particles size from 1 to 130 and the graphite fibers range from about 1/64" to about 1/2" in length and from about 0.002" to about 0.0002" in diameter.

In preparing the intrinsically conductive piezoresistive foam and rubber, a fluid coating material including green rubber, blowing agent, and a conductive filler of graphite powder and graphite fiber is prepared and applied to the green rubber substrate and dried. Upon curing, the conductive coating will expand into a layer of conductive cellular foam.

The fluid coating composition can be deposited by spraying, casting, roller application, silk screening, rotogravure printing, knife coating, curtain coating, offset coating, extrusion glue head coating or other suitable method. The liquid composition of Table I or II is transformed into a solid film by evaporating the solvent or other fluid, thereby leaving only the compounded binder with conductive filler incorporated therein as an elastomeric solid coating.

Yet an other embodiment of applying the conductive coating is to first coat a strip (the electrode width) of green rubber on its top surface with conductive coating. This conductive coated strip is longitudinally pressure laminated to the green rubber second base layer. Subsequent curing provides a chemical bond of the conductive coated strip to the base layer. This raised strip of conductive coating can also serve as a sensitizing ridge.

Further, a strip of green rubber filled with graphite and graphite fibers and blowing agent cut from sheet or extruded to the electrode width can be used. This prefoamed green rubber strip can be longitudinally pressure laminated to the green rubber second base layer. Subsequent vulcanization provides a chemical bond of the pre-foamed green strip to the base layer and simultaneously activates the blowing agent to expand the green rubber into a foamed rubber. This raised strip of conductive green rubber can also serve as a sensitizing ridge.

The conductive coating composition can be applied to form a simple planar film or, alternatively, may be contoured into various planar shapes or patterns. The dried conductive film is elastomeric and serves as an electrode in the pressure actuated switching device and can have any suitable thickness. Preferably, the conductive coating has a thickness ranging from 0.05 mil to 60 mils (1 mil=0.001 inch), more preferably from 1 mil to 10 mils. The percentage of conductive filler in the dried conductive electrode film can preferably range from 50% to 95%, and imparts a conductivity to the conductive film preferably ranging from 0.001 to 500 ohms per square, more preferably from 0.1 to 10 ohms per square. In terms of specific resistance, the conductive electrode film can possess a resistivity approaching that of metallic silver, or higher depending on the amount and type of conductive filler used and its composition percentage in the conductive electrode film.

Figure 2:
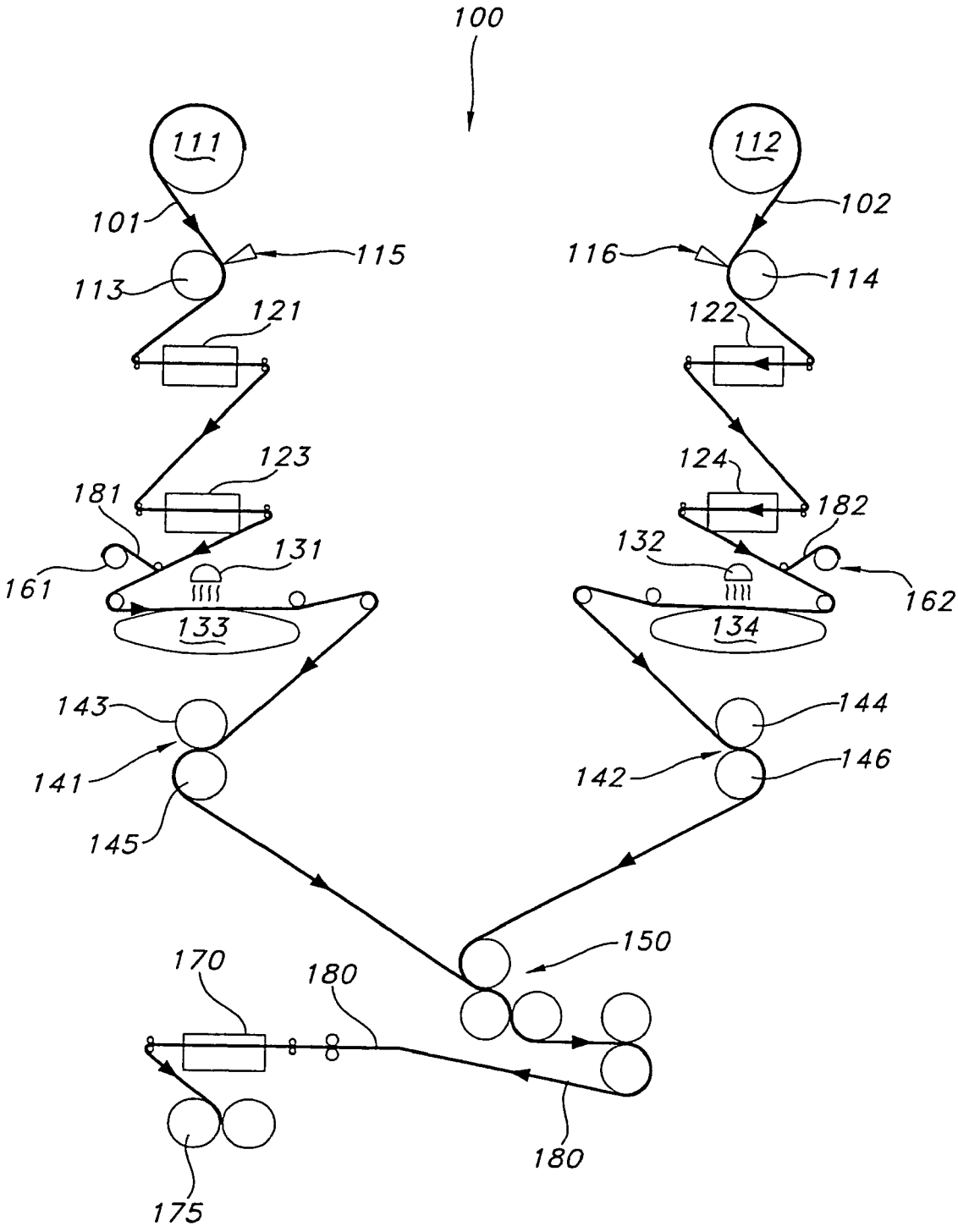
FIG. 2 is a diagrammatic illustration of a system and rotary process for making a tubular sensor.

Referring now to FIG. 2, a system 100 for rotary fabricating a tubular sensor is illustrated wherein calendered green rubber sheets 101 and 102 are drawn from rolls 111 and 112 respectively. The green rubber sheets 101 and 102 each have a release sheet of non-stick film such as polyethylene film in contact with one side of the green rubber sheet. The green rubber sheets 101 and 102 are slit to a desired predetermined width by being transferred around rolls 113, 114, respectively while being cut by knives 115 and 116, respectively. The green rubber sheets 101 and 102 are then sent through coating stations 121 and 122 respectively wherein conductive electrode coatings are applied to the surface of the green rubber sheets. The green rubber sheets 101 and 102 are thereafter sent to drying stations 123 and 124, respectively wherein the fluid conductive electrode coatings are dried, or otherwise solidified or rendered into a non-fluid state, to form solid elastomeric conductive electrode green state coatings.

Release films 181 and 182 are present on the uncoated surface of the green rubber sheets, 101 and 103, which are then sent to stripping station 161 and 162 wherein the respective release films 181 and 182 are removed. The sheets 101 and 102 are then optionally sent to preheating stations 133 and 134 respectively, wherein the sheets are warmed to a temperature of from about 110° F. to about 250° F. Warming can be achieved by, for example the use of radiant heat lamps 131 and 132, hot air blower, or by passing the sheets through an oven, or any other suitable method.

The sheets 101 and 102 as then sent to forming stations 141 and 142, respectively wherein the sheets 101 and 102 are shaped and configured. For example, sheet 101 can be designated as the cover and can be conformed into a generally U-shaped configuration.

Figure 3:
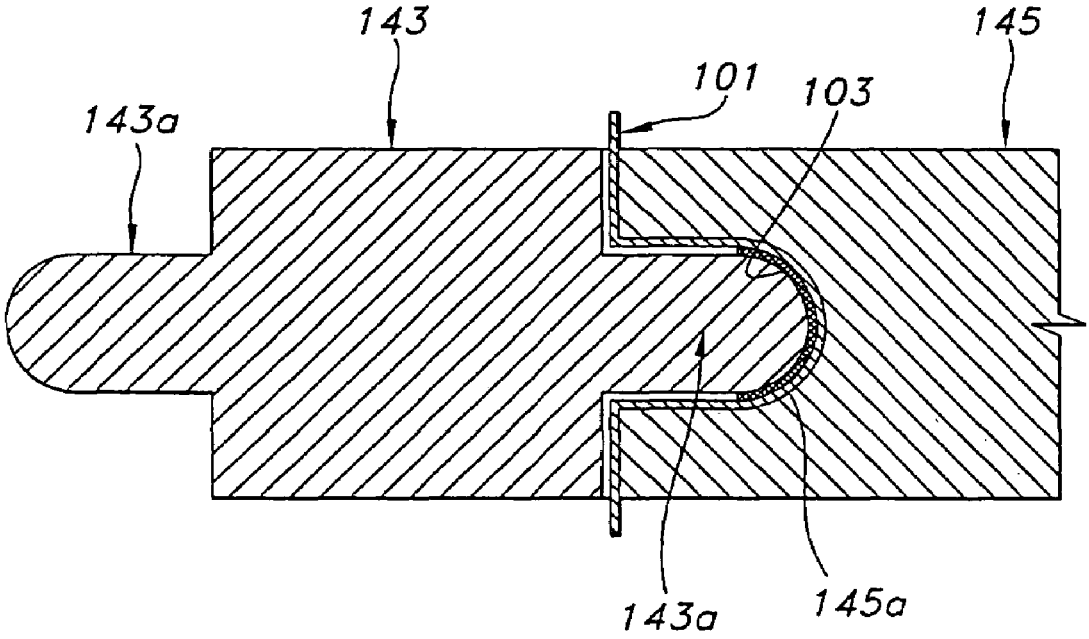
FIG. 3 is a sectional view of rolls used for shaping a sheet of green rubber.

Referring now to FIG. 3, sheet 101 with conductive electrode coating 103 is passed between rolls 143 and 145.

Roll 145 is a female tuck roll which includes a U-shaped recess 145*a* which extends circumferentially around the edge of roll 145. Roll 143 is a male nip roll which includes a circumferential projection 143*a* for tucking the sheet 101 into the U-shaped projection 143*a* for tucking the sheet 101 into the U-shaped recess 145*a* of the tuck roll to form the sheet 101 into a U-shaped configuration.

Sheet 102, is formed into the desired configuration by rolls 144 and 146. As a base substrate, sheet 102 can simply retain a flat configuration.

Figure 4:
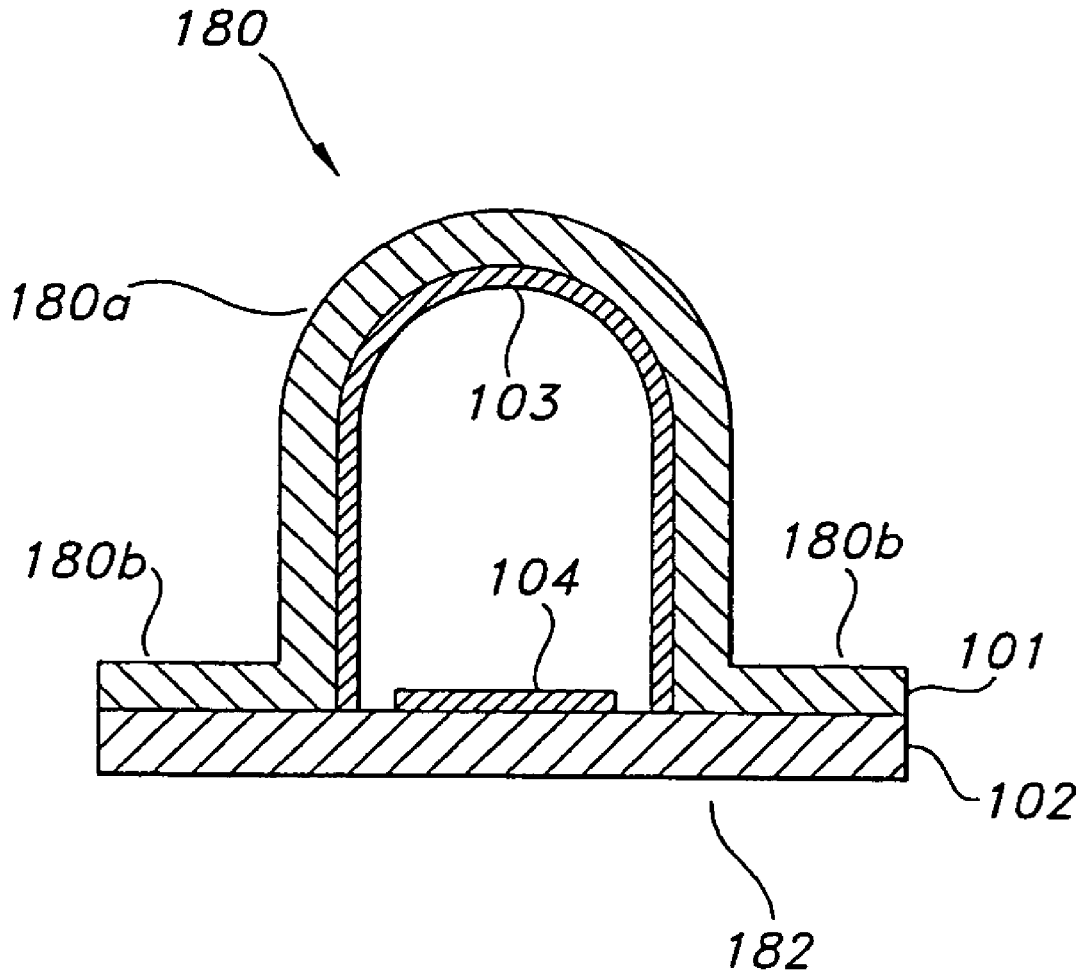
FIG. 4 is a sectional view of an embodiment of the tubular sensor at a stage prior to curing.

Both sheets 101 and 102 are then sent to a mating station 150 wherein sheets 101 and 102 are joined and sealed along the flanges to assemble the tubular sensor 180, which has a cross section such as shown in FIG. 4.

Referring to FIG. 4, tubular sensor 180 includes cover 101, having a conductive electrode coating 103 and base 102 having a conductive electrode coating 104. The tubular sensor 180 includes a U-shaped upper portion 180*a* and lateral flange portions 180*b* which are sealed.

Referring again to FIG. 2, the tubular sensor 180 is then conveyed through a vulcanizing oven 170 wherein the green rubber is then cured by cross-linking the molecular structure. The curing of the green rubber provides a permanent shaped rubber, which when physically compressed is virtually free of compressive set. The curing process enhances the sealing of the edges of the tubular sensor, with a chemically linked vulcanized bond. When the conductive electrode coatings are formulated with the similar green rubber, the curing provides vulcanized adhesion of the conductive coating to the inner surfaces of the cover and base portions. That is, by co-vulcanization of the substrate sheets and the conductive electrode coatings, the conductive electrode coatings are cross-linked to the cover and base substrate, respectively. The conductive coatings then become an integral part of the structure.

Finally, the tubular sensor 180 is conveyed to a cooling station (not shown) and then to reel 175 onto which the tubular sensor is wound for storage and transport.

Figure 2A:
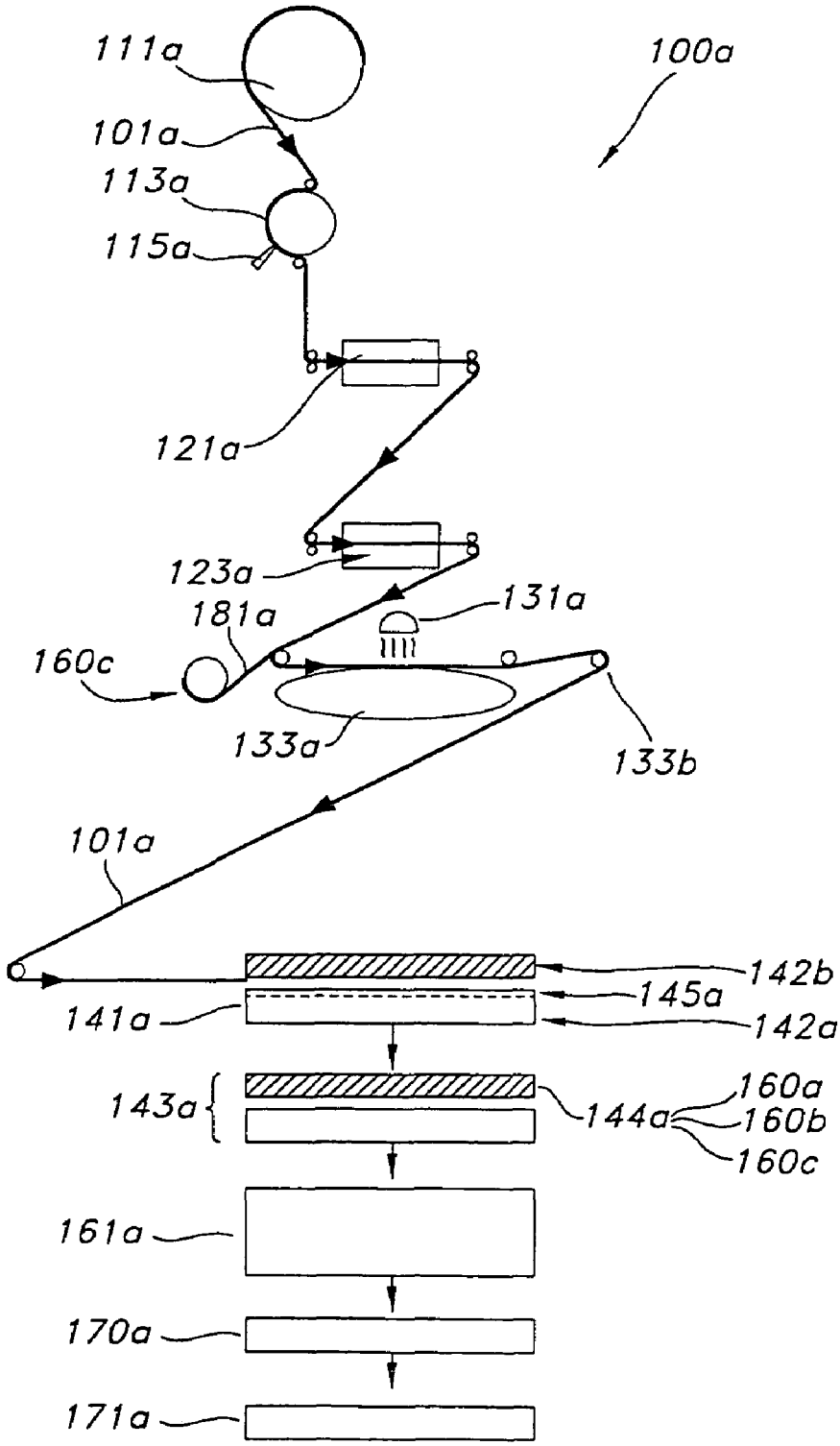
FIG. 2A is a diagrammatic illustration of a system and automatic linear transfer process for making a tubular sensor.

Referring now to FIG. 2A, for an advantageously lower capital investment requirement, an alternative process for fabricating a tubular sensor, a stamping process designated herein as automated linear transfer manufacturing line system 100*a*, is illustrated. In the automated linear transfer manufacturing line system 100*a*, a calendered relatively wide sheet 101*a* of green rubber is drawn from roll 111*a*. The green rubber sheet 101*a* has a release sheet 181*a* of non-stick film such as polyethylene film in contact with one side of the green rubber sheet 101*a*. The green rubber sheet 101*a* is slit to a desired predetermined width by being transferred around roll 113*a* while being cut by a knife 115*a*. The sheet 101*a* is then sent through a coating station 121*a*, wherein a conductive electrode coating (item 103 of FIG. 4) is applied to the surface of the green rubber slit sheet. The coated sheet 101*a* is thereafter sent to drying station 123*a*, wherein the fluid conductive electrode coating is dried, or otherwise solidified or rendered into a non-fluid state, to form solid elastomeric conductive electrode green state coating. Green rubber sheet, 101*a* with release film 181*a* present on the uncoated surface is then sent to stripping station 160*c*, wherein the release film 181*a* is removed.

The coated green rubber sheet 101*a* is then optionally sent to preheating station 133*a*, wherein the sheet is warmed to a temperature of from about 110° F. to about 250° F. Warming can be achieved by, for example the use of radiant heat lamp 131*a*, a hot air blower, or by passing the sheets through an oven, or any other suitable method.

From the common roll-off source 133*b* the sheet 101*a* is then sent to a forming station 141*a*, wherein the sheet 101*a* is shaped and configured by a clamping press. For example, sheet 101*a* can be designated as the cover and can be conformed into a generally U-shaped or C-shaped configuration.

Figure 2C:
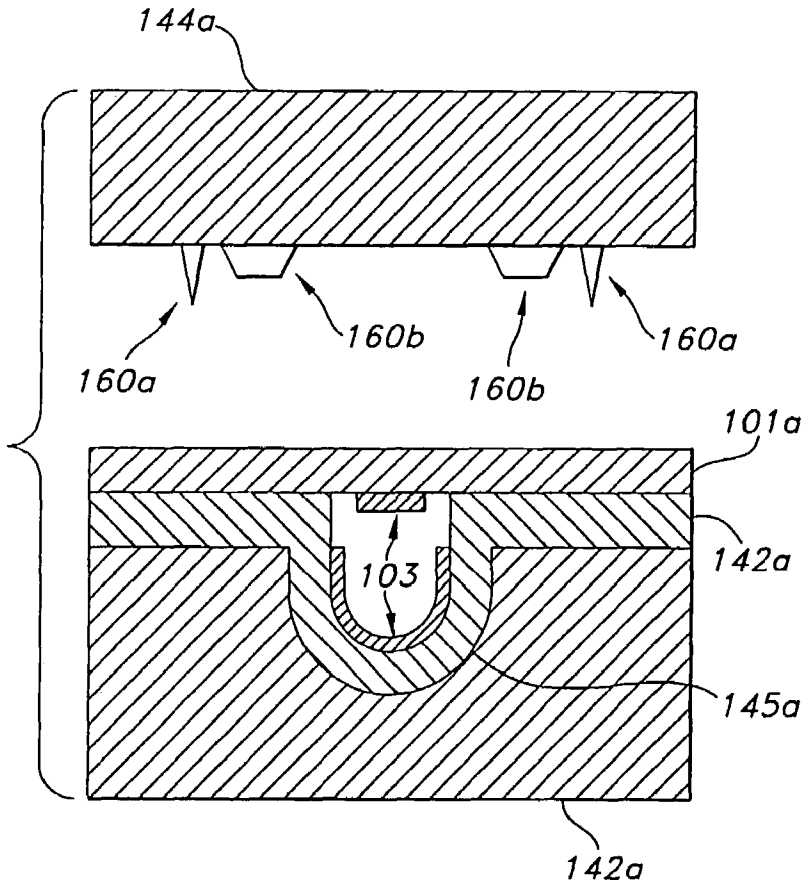
FIG. 2C is a sectional view of a mating station equipment configuration.
Figure 2B:
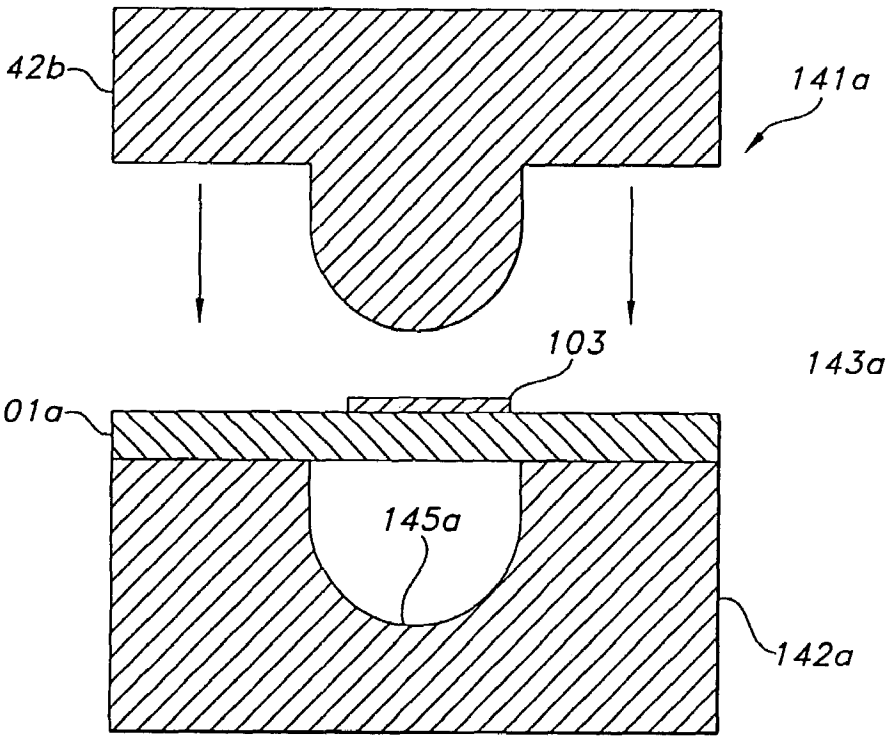
FIG. 2B is a sectional view of the clamping press forming station equipment configuration.

Referring to FIGS. 2A and 2C, sheet 101*a*, with conductive electrode coating 103 (FIG. 4) is linearly transferred from the common roll-off source to clamping press forming station 141*a*. This station includes an indexing mechanism, and a tucking die 142*a* with a U-shaped female recess 145*a* which extends to form the desired length of the elongated tubular sensor. This station's capability also includes: a sheet length cutoff blade, a precision slit sheet locating mechanism, a multi-die transfer mechanism and die air strip jet ejection accommodation. These features can be accomplished with known commercially available machinery. A die male portion 142*b*, includes a U-shaped projection 142*c* for tucking, and as a result of closing or clamping the press pushes the sheet 101*a* into the U-shaped recess 145*a*, to form the sheet 101*a* into a U-shaped configuration.

Referring also now to FIG. 2C, coated sheet 101*a*, is also used to form the desired top and bottom tubular configuration, illustrated in FIG. 4. As the base substrate, sheet 101*a* is simply retained as a flat configuration. For the purpose of illustrating this procedure the clamping press is shown in FIG. 2A as a second press, but in principle the same clamping press is used, but with substituted dies. After opening the press, and with the female die portion 142*a*, still loaded with the U-shape formed green rubber sheet 101*a* remaining in die portion 142*a*, die male portion 142*b* is shuttle transferred out of its press clamp location and replaced with the edge mating and cutting die 144*a*. From the common roll-off source 133*b*, the sheet 101*a* is turned so that the coated electrode face is oriented down, and is then sent to the clamping press station in which the dies are configured and set up as a mating station 143*a*. The sheet 101*a* is precision placed wherein the U-shape formed green rubber sheet is still located in the female die portion 142*a*. Clamping pressure joins the bottom sheet 101*a*, with the coated electrode face oriented down, the U-shape formed green rubber top sheet thus mating and sealing them along the flange areas. This mating operation provides the assembled mated green rubber tubular sensor 180, which has the same tubular cross section such as shown in FIG. 4, with green rubber edge excess.

This same clamping operation involves trimming the green rubber edge excess, simultaneously, while the mating the bottom and U-shape covers, because adapted to the upper die 144*a* are cutting edges 160*a*, which are located parallel to mating flange die projections 160*b*. Clamping the press trims off the excess. The green rubber trimmed tubular sensor 180 is air ejected released and then linearly transferred from the mating station die setup 143*a* and sent to the batch or conveyer vulcanizing oven 161*a* wherein the green rubber is then cured by cross-linking the molecular structure. Finally, the tubular sensor 180 body is linear transferred to a cooling station 170*a* and allowed to cool. The cured tubular sensor body 180 is linear transferred to holding station 171*a* for assembly, storage or transport. Vulcanization achieves the same results as described in the rotary system.

Figure 5:
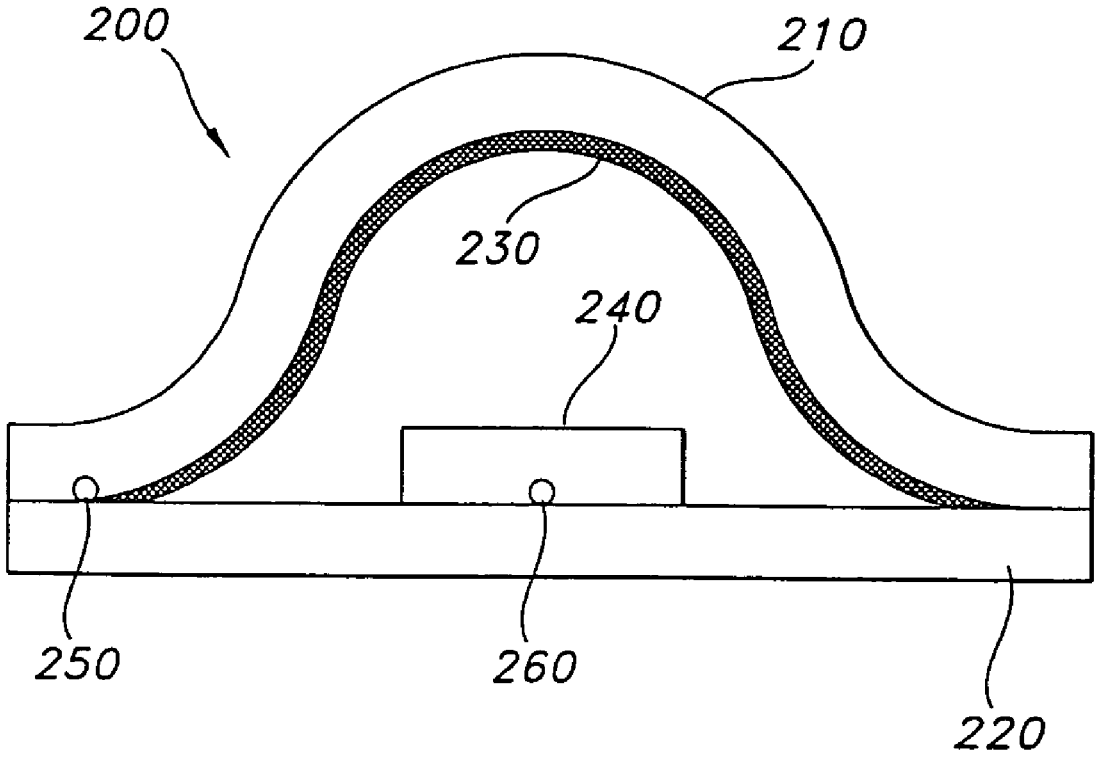
FIG. 5 is a sectional view of another embodiment of the tubular sensor.

Referring now to FIG. 5, an elongated pressure actuated switching device 200 is illustrated wherein both cover 210 and base 220 are elastomeric polymers derived from the vulcanization of green rubber. The conductive electrode coating 230 on the inside surface of the cover 210 is a relatively thin conductive film. The conductive electrode 240 on the upper, inside surface of the base 220 is an intrinsically conductive polymer foam derived by the expansion and vulcanization of a conductive green rubber containing both conductive powder and conductive fibers. Conductive wires 250 and 260 are preferably installed together with the conductive electrode coatings 230 and 240, respectively, and extend lengthwise through the pressure actuated switching device 200 in contact with the respective conductive electrode coatings to provide terminal contacts therefor. Wires 250 and 260 extend outside the pressure actuated switching device 200 to permit electrical connection of the conductive electrode coatings 230 and 240 with an electrical circuit.

Figure 5A:
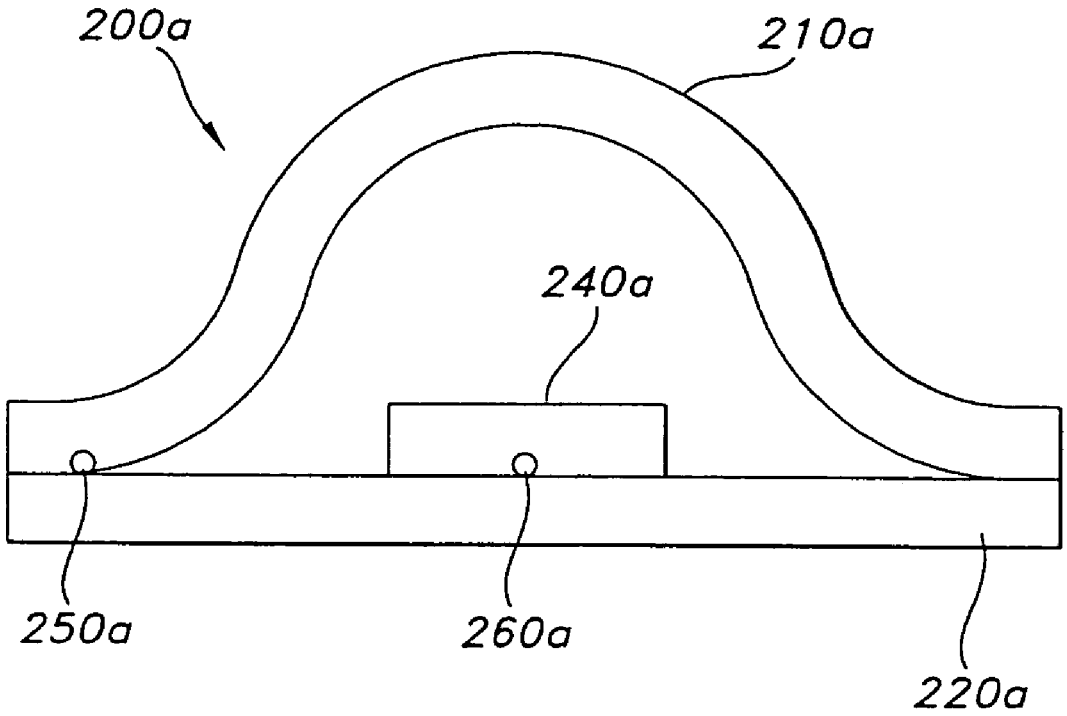
FIG. 5A is a sectional view of still another embodiment of the tubular sensor.

Referring now to FIG. 5A, an elongated pressure actuated switching device 200*a* is illustrated wherein cover 210*a* is an arcuate shaped conductive green rubber, and base 220*a* is a flat layer of electrically insulative green rubber. The conductive electrode 240*a* on the upper, inside surface of the base 220*a* is green rubber filled with graphite, graphite fibers and blowing agent. This conductive electrode 240*a* is initially in the form of a preformed green rubber strip which is longitudinally pressure laminated to the green rubber base layer 220*a*. Conductive wires 250*a* and 260*a* are preferably installed together with the conductive electrode 240*a*, respectively, and extend lengthwise through the pressure actuated switching device 200 and provide terminal contacts for the conductive electrode cover 210*a* and the conductive electrode 240*a* which is expanded by vulcanization to form intrinsically conductive foam, respectively. Vulcanizing cures the rubber, and chemically bonds all the interface surface while expanding the conductive foam. Wires 250*a* and 260*a* extend outside the pressure actuated switching device 200*a* to permit connection with an electrical circuit.

Figure 6A:
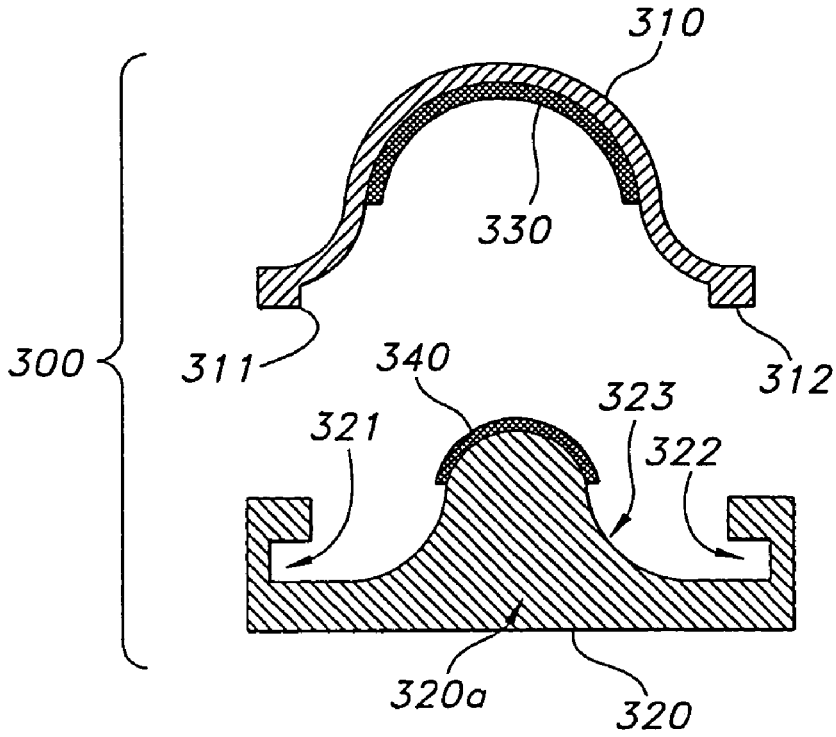
FIG. 6A is an exploded sectional view of another embodiment of the tubular sensor.
Figure 6B:
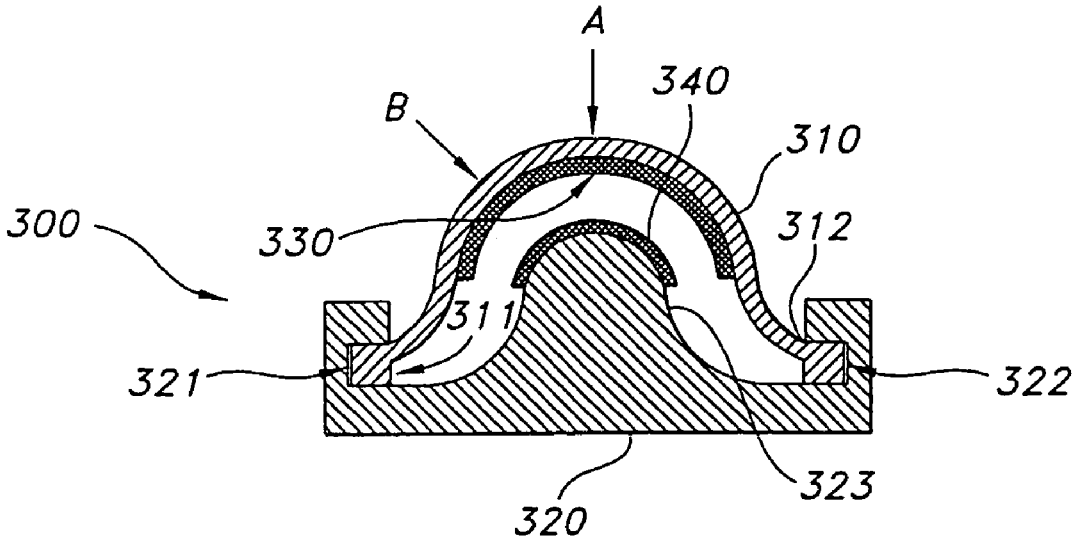
FIG. 6B is an assembled view of the embodiment shown in FIG. 6A.

Referring now to FIGS. 6A and 6B, elongated pressure actuated switching device 300 includes an arcuate cover 310 and a base 320, both of which are elastomeric polymers derived by the vulcanization of green rubber. Base 320 includes an upwardly projecting sensitizing ridge 323 to facilitate actuation of the device when a force is applied to the cover 310 either downwardly from above or at an angle from the side. Conductive electrode coating 330 extends along the inside curved surface of cover 310. Conductive electrode coating 340 extends along the curved crest of ridge 323.

Pressure actuated switching device 300 has a snap-together type lengthwise extending male insert edges 311 and 312 in cover 310 which are adapted to snap into and engage corresponding female snap-in linear recesses 321 and 322 in the base 320. The resiliency of the cover 310 enables the snap-together assembly of the cover 310 and base 320. An adhesive optionally can be applied to the snap-together type joints to securely join the cover 310 to the base 320 and to provide a seal at the joint which prevents leakage in or out of gas or moisture. The snap-together joint holds the members together while the adhesive cures.

Alternatively, the cover 310 can be prepared as green rubber, with a green rubber conductive coating. After snapping together, co-vulcanization cures the coating and simultaneously curing the green rubber cover and base while providing a chemically linked bond at the recess junctions.

Figure 7A:
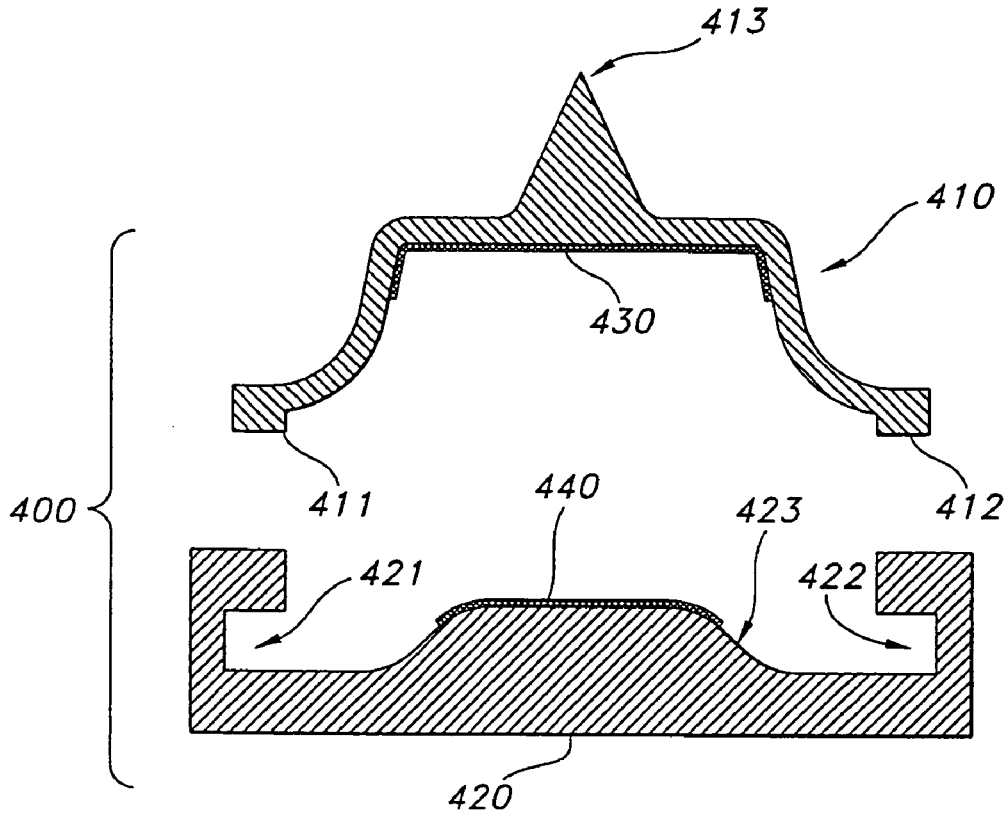
FIG. 7A is an exploded sectional view of another embodiment of the tubular sensor.
Figure 7B:
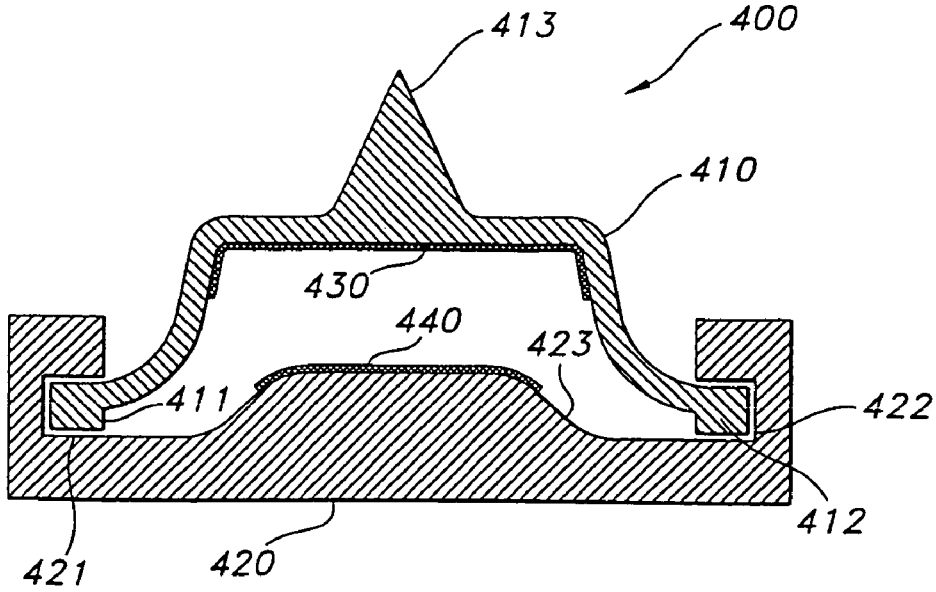
FIG. 7B is an assembled view of the embodiment shown in FIG. 7A.

Referring now to FIGS. 7A and 7B, an elongated pressure actuated switching device 400 includes a cover 410 and base 420, at least the cover 410 being an elastomeric polymer derived from the vulcanization of green rubber. Conductive electrode coating 430 is disposed along the inside surface of cover 410. Cover 410 includes lengthwise extending male insert edges 411 and 412, and an upwardly projecting ridge 413. The male insert edges 411 and 412 are adapted to engage corresponding female recesses 421 and 422 in the base to provide a snap-together assembly, as discussed with embodiment 300 described above. Optionally, adhesive can be used to further secure the joining of the members. Ridge 413 is a sensitizing ridge. That is, it provides greater sensitivity to an externally applied force.

Base 420 includes lengthwise extending female recesses 421 and 422 which are adapted to receive corresponding male insert edges 411 and 412 of the cover for snap-in type engagement. Base 420 includes a longitudinally extending upwardly projecting ridge 423. Conductive electrode coating 440 is disposed along the upper surface of the ridge 423.

Figure 7C:
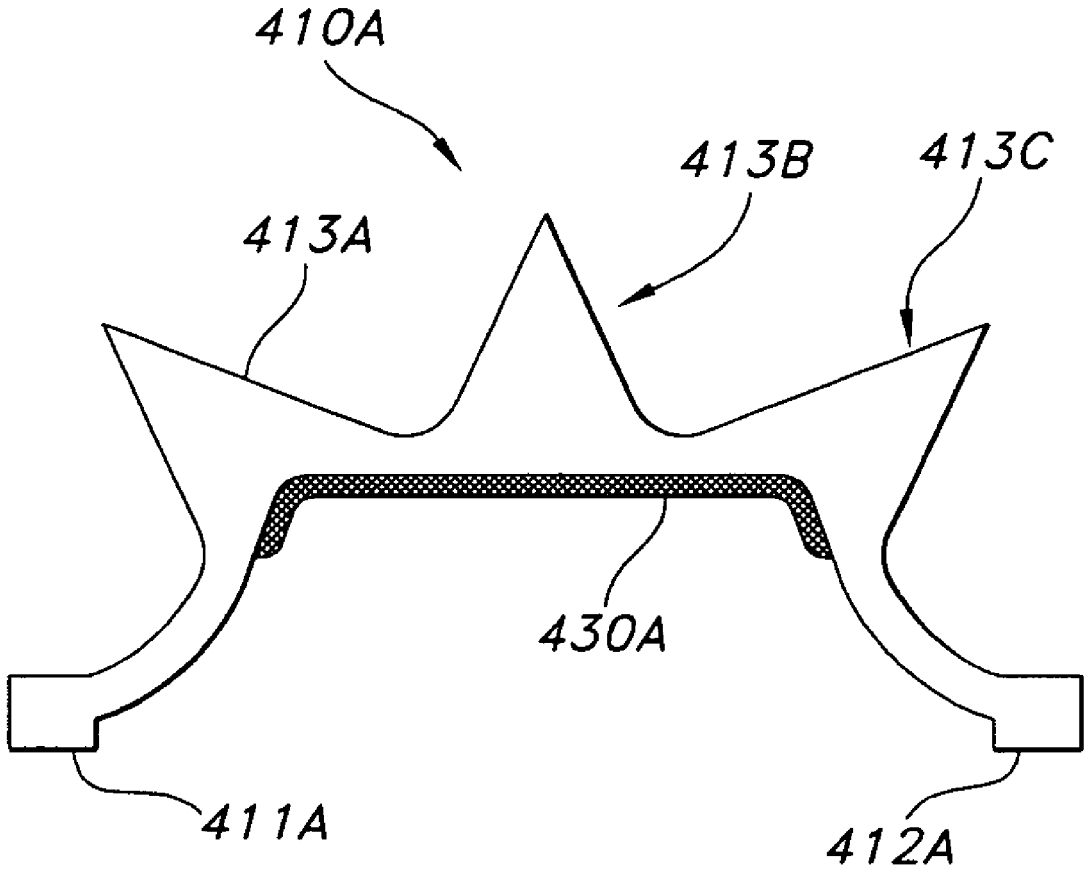
FIG. 7C is a sectional view of an alternative embodiment of a cover.

Referring now to FIG. 7C, an alternative embodiment 410A for the cover is shown. Cover 410A is similar to cover 410 except that cover 410A includes three sensitizing ridges 413A, 413B, and 413C. Sensitizing ridge 413B projects vertically upward, whereas sensitizing ridge 413A projects upward but at an angle towards one side of the pressure actuated switching device and sensitizing ridge 413C extends upwardly and at an angle towards the other side of the pressure actuated switching device. Male insert edges 411A and 412A are adapted to engage corresponding recesses 421 and 422, respectively, of the base 420. Conductive electrode coating 430A is disposed on the inside surface of cover 410A.

Figure 8A:
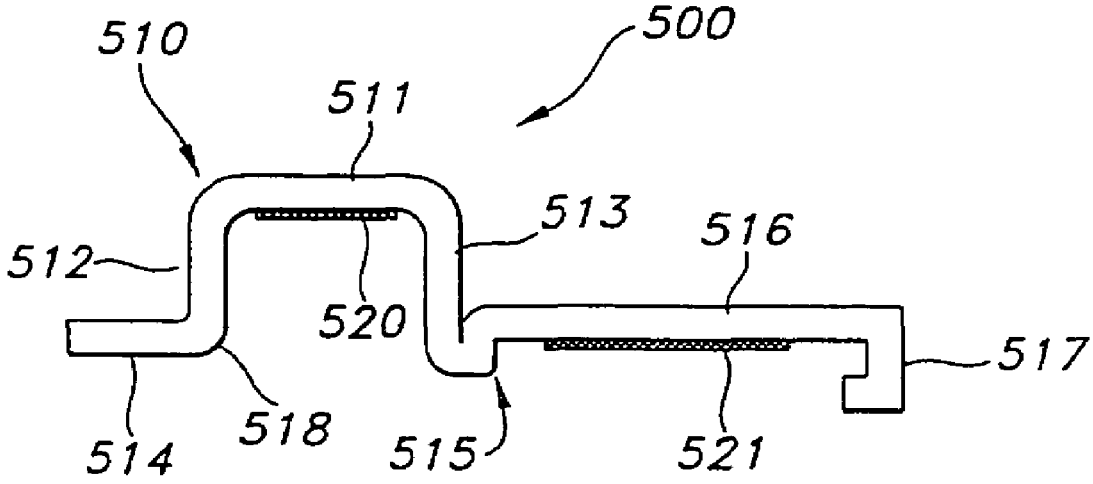
FIG. 8A is an illustration of an alternative embodiment of the tubular sensor in an open configuration with latch portion.
Figure 8B:
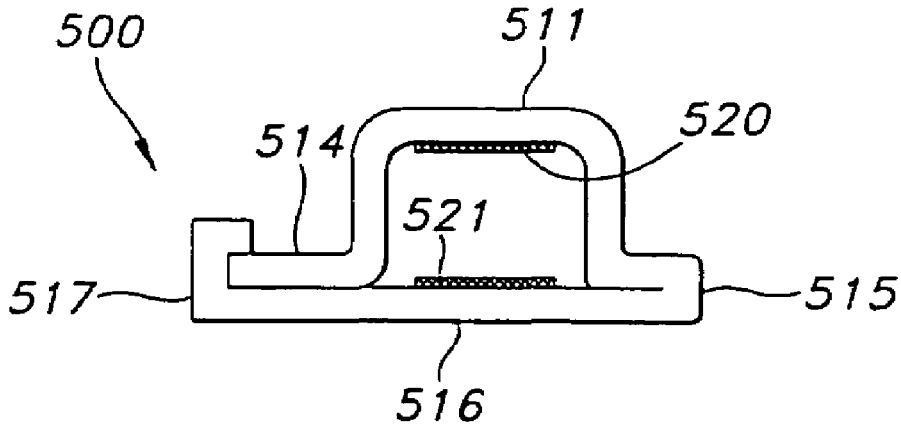
FIG. 8B is an illustration of the embodiment of FIG. 8A in a closed configuration.

Referring now to FIGS. 8A and 8B elongated pressure actuated switching device 500 comprises a sheet of elongated elastomeric polymer 510 which is derived from green rubber. Sheet 510 is configured to have a cover portion which includes an upper wall 511 and side walls 512 and 513. A flange portion 514 joins side wall 512 at bend 518 and extends laterally therefrom. A base portion 516 is joined to side wall 513 by means of hinge portion 515. Base portion 516 terminates at its free end in a latch portion 517.

Conductive electrode coating 520 is disposed on the bottom (as shown in FIG. 8A) surface of upper wall 511. Conductive electrode coating 521 is disposed on a surface of the base portion 516 which, as shown in FIG. 8B, becomes an upper, interior surface when the base portion is folded over. The pressure actuated switching device 500 as manufactured as a single sheet with a configured cross section. The sheet is then process by bending the base portion around at hinge 515 and engaging the free end of flange portion 514 with the latch portion 517 so as to form an enclosed structure as shown in FIG. 8B. Vulcanizing the folded configuration creates a resilient tubular sensor switch. Post cure application of an adhesive to the latch position provides a seal and bond.

Figure 8C:
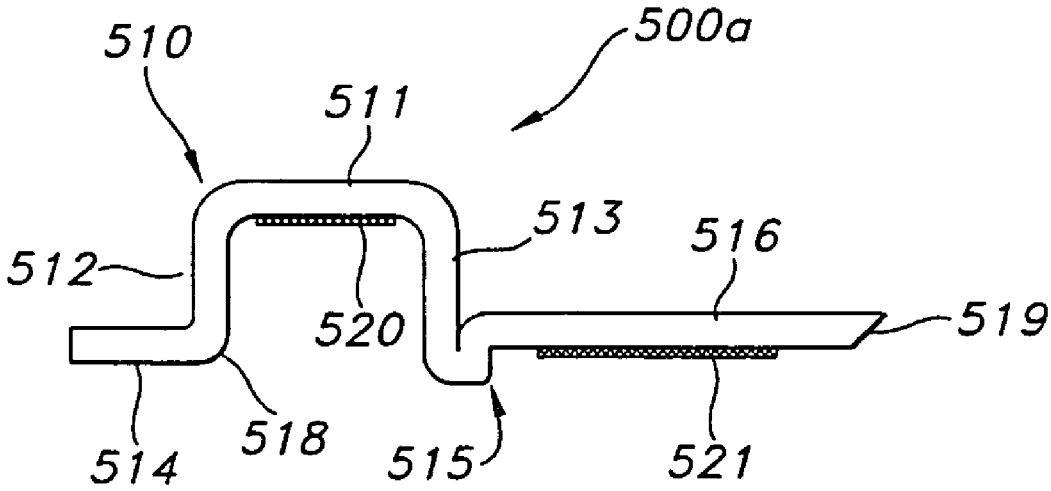
FIG. 8C is an illustration of an alternative embodiment of the tubular sensor in an open configuration without latch portion.
Figure 8D:
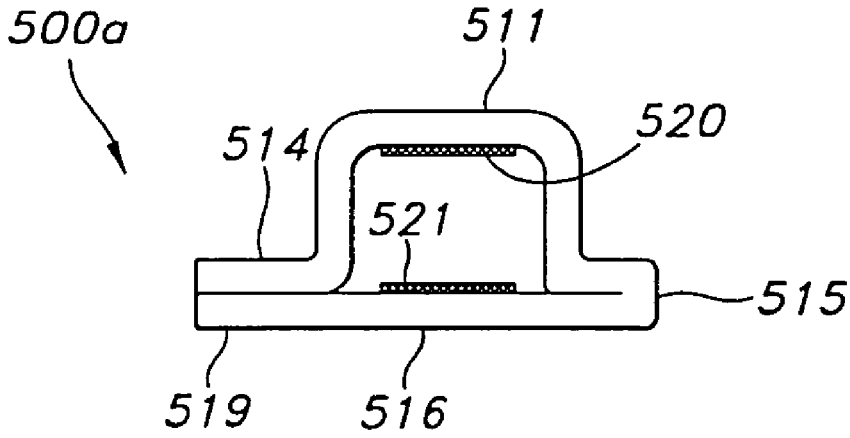
FIG. 8D is an illustration of the embodiment of FIG. 8A1 in a closed configuration.

Alternatively, the pressure actuated switching device 500*a* shown in FIGS. 8C and 8D is similar to device 500 shown in FIGS. 8A and 8B, except that the latch portion 517 is eliminated. Insulative end portion 519 is folded over from the open position as shown in FIG. 8C to a closed position as shown in FIG. 8D wherein end portion 519 is pinched against flange portion 514. Pinch merging of the boundary of flange 514 and 519, as a result of vulcanization forms a cured rubber chemical bond and a fluid-impervious seal.

Figure 9:
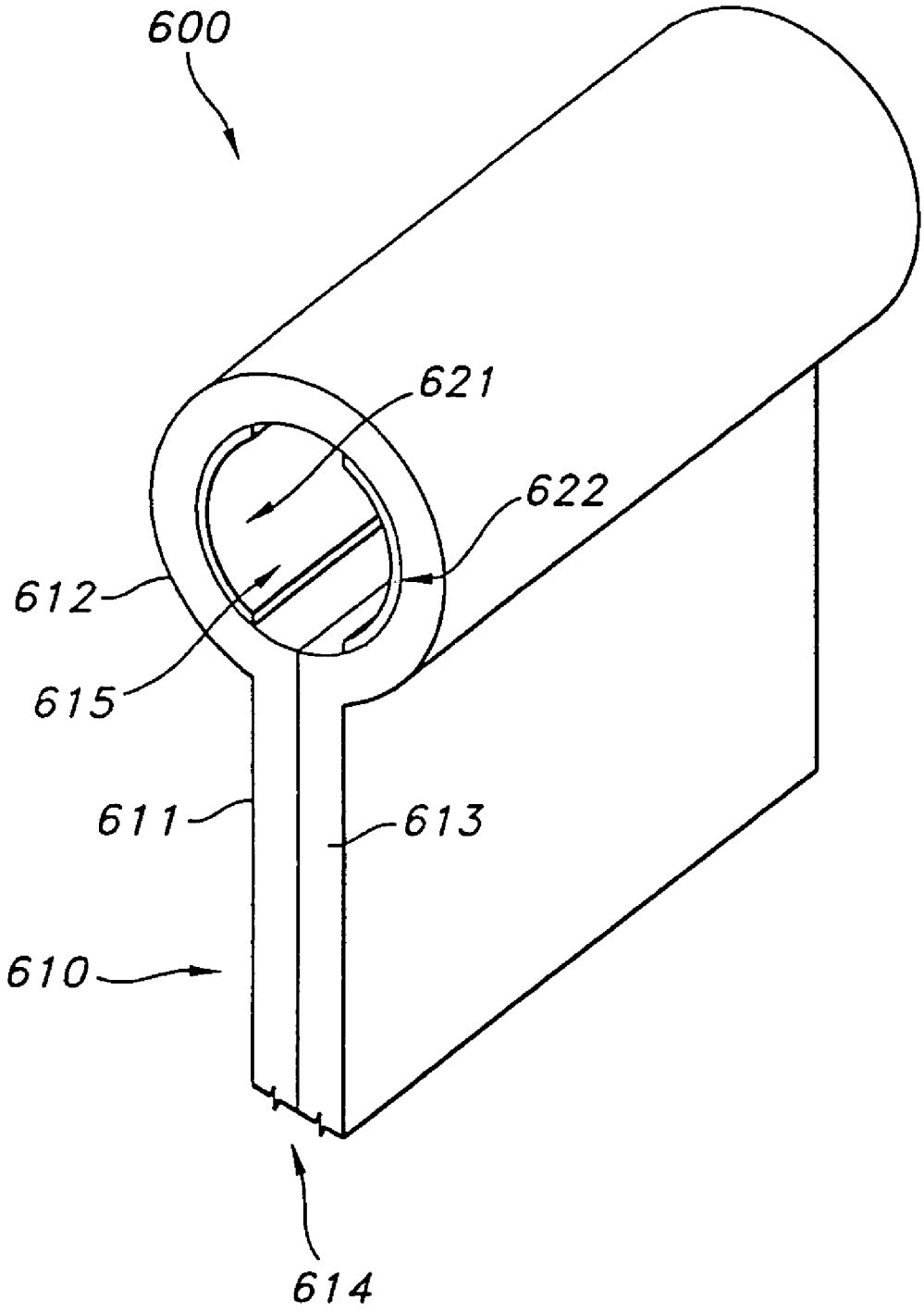
FIG. 9 is a perspective view of an alternative embodiment of the tubular sensor.

Referring now to FIG. 9, an elongated pressure actuated switching device 600 includes a cover 610 fabricated from an elastomeric polymer derived from single green rubber slit sheet. The electrodes of this configuration are coated in the appropriate pattern and the rubber looped as shown. Cover 610 includes a first vertical side wall 611, an upper tubular portion 612 defining an interior lengthwise opening 615, and a second vertical side wall 613. Preferably, tubular portion 612 has a circular cross section. Nevertheless, alternative cross sections such as oval, square, rectangular, triangular, etc., are also contemplated. Conductive electrode coatings 612 and 622 are disposed lengthwise along the inside surface of the upper tubular portion 612 in spaced apart relation to each other. Side walls 611 and 613 are adjacent to and in contact with each other. The conductive electrode coatings 621, 622 are attached to respective wires (not shown) so that the pressure actuated switching device 600 can be incorporated into an electrical circuit. Together, walls 611 and 613 form a flange and are joined by pinching together to an upright support which can be mounted to a clamp or other means of fixture. The pressure actuated switching device 600 is actuated when a force of sufficient magnitude is applied to the tubular portion 612 so as to collapse the tubular portion and bring the conductive electrode coatings 621 and 622 into contact with each other.

The vertical walls 610 and 611 can be bonded at interface 614 with adhesive if the cover 610 is pre-vulcanized, or walls 610 and 611 can be pinch merged as green rubber, followed by post-assembly vulcanization to produce a chemically linked seal and bond at interface 614.

Figure 10:
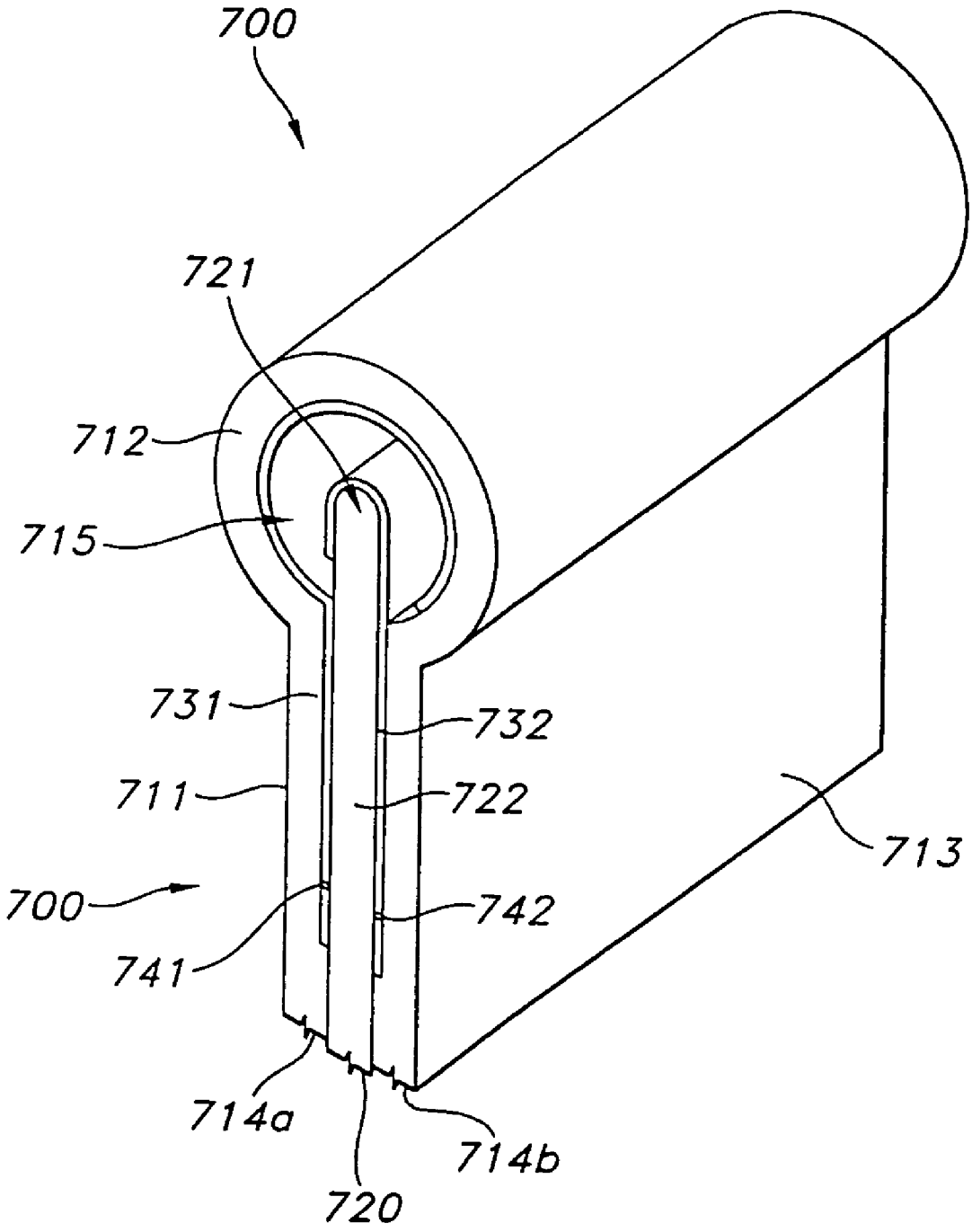
FIG. 10 is a perspective view of another alternative embodiment of the tubular sensor.

Referring now to FIG. 10, an elongated pressure actuated switching device 700 includes a cover 710 fabricated from an elastomeric polymer derived from green rubber slit sheets. Cover 710 includes a first flange-forming side wall 711, an upper tubular portion 712 defining an interior lengthwise bore 715, and a second flange-forming side wall 713. Preferably, tubular portion 712 has a circular cross section. Nevertheless, alternative cross sections such as oval, square, rectangular, triangular, etc., are also contemplated. A flat second member 720 includes a top end portion 721 and a flange portion 722. The flange portion 722 of the second member 720 is disposed between the first and second flange-forming side walls 711 and 713. The top end portion 721 of second member 720 extends into the bore 715 of the tubular portion 712. A first conductive electrode coating 731 is disposed along the surface of the first flange-forming side wall 711 at the interface between the first side wall 711 and second member 720, and also around the interior surface of the tubular portion 712. Second conductive electrode coating 732 is disposed along the surface of the side of the second member 720 at the interface between the center member 720 and the second side wall 713, and also around the top of the end portion 721 and partially along the opposite side of the second member. Terminal wires 741 and 742, in contact respectively, with conductive electrode coatings 731 and 732, extend longitudinally along the pressure actuated switching device 700 at the interfaces 714*a* and 714*b*, respectively, between second member 720 and the first and second side walls 711 and 713. Terminal wires provide electrical contact between the conductive electrode coatings 731 and 732 and an outside electrical circuit. The interfaces 714*a* and 714*b* can be bonded and sealed with adhesive, if the cover 710 has already been pre-vulcanized, or second member 720 and the first and second walls 711 and 713 can be pinch merged as green rubber followed by post-assembly vulcanization to produce a chemically linked seal and bond interfaces 714*a* and 714*b*.

Figure 11:
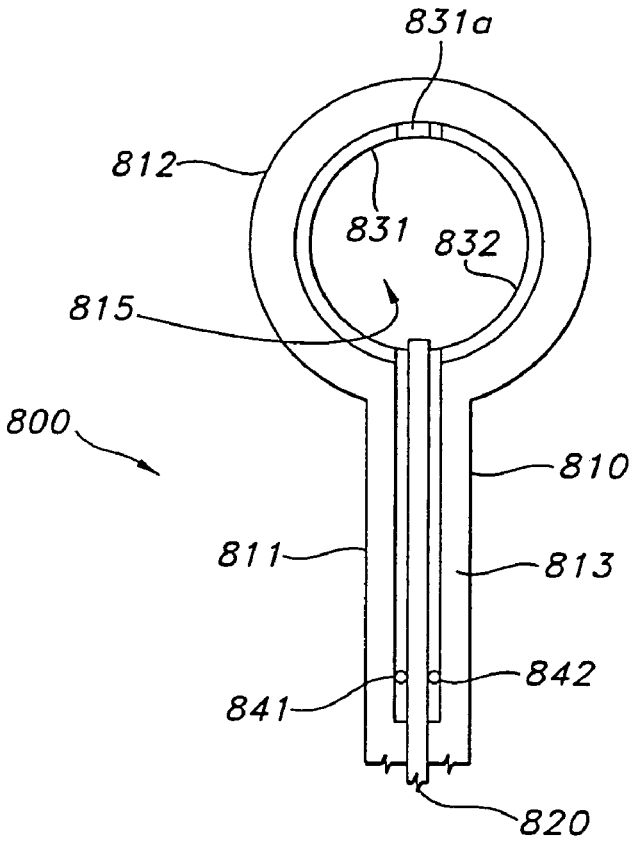
FIG. 11 is an end view of yet another embodiment of the tubular sensor.

Referring now to FIG. 11, an elongated pressure actuated switching device 800 includes a cover 810 preferably fabricated from an elastomeric polymer derived from two green rubber sheets.

Cover 810 includes a first vertical side wall 811, an upper tubular portion 812 defining a lengthwise interior opening 815, and a second vertical side wall 813. Preferably, tubular portion 812 has a circular cross section. Nevertheless, alternative cross sections such as oval, square, rectangular, triangular, etc., are also contemplated. A flat member 820 is disposed between the first and second side walls 711 and 713. A first conductive electrode coating 831 is disposed along the surface of the first side wall 811 at the interface between the first side wall 811 and center member 820, and also partially around the interior surface of the tubular portion 812. Second conductive electrode coating 832 is disposed along the surface of the second side wall 813 at the interface between the second side wall 813 and the center member 820 and also partially around the interior surface of the tubular portion 812.

Figure 12:
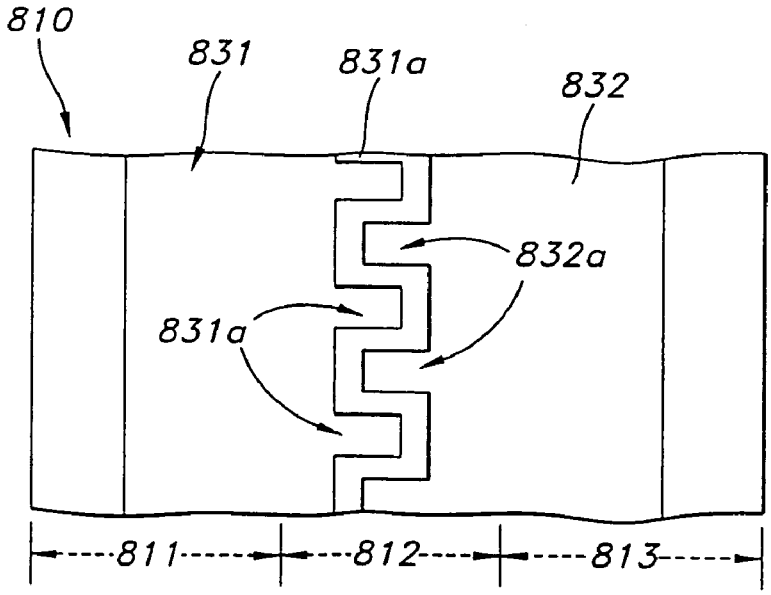
FIG. 12 is a plan view of the cover sheet used in the embodiment of the tubular sensor shown in FIG. 11.

Referring now to FIG. 12, the cover 810 is illustrated in a pre-configured, flat condition. As can be seen, the opposing edge portions of the first and second conductive coatings 831 and 832 are configured in a crenelate pattern. The first conductive electrode coating 831 includes a plurality of spaced apart teeth 831*a* projecting towards the opposing edge of the second conductive electrode coating 832. The second conductive electrode coasting 832 includes a plurality of spaced apart teeth 832*a* projecting towards the opposing edge of the first conductive electrode coating 831 so as to form an interdigitated pattern therewith.

Referring again to FIG. 11, terminal wires 841 and 842, in contact, respectively, with conductive electrode coatings 831 and 832, extend longitudinally along the pressure actuated switching device 800 at the interfaces between center member 820 and the first and second side walls 811 and 812. Terminal wires provide electrical contact between the conductive electrode coatings 831 and 832, and an outside electrical circuit.

Figure 13:
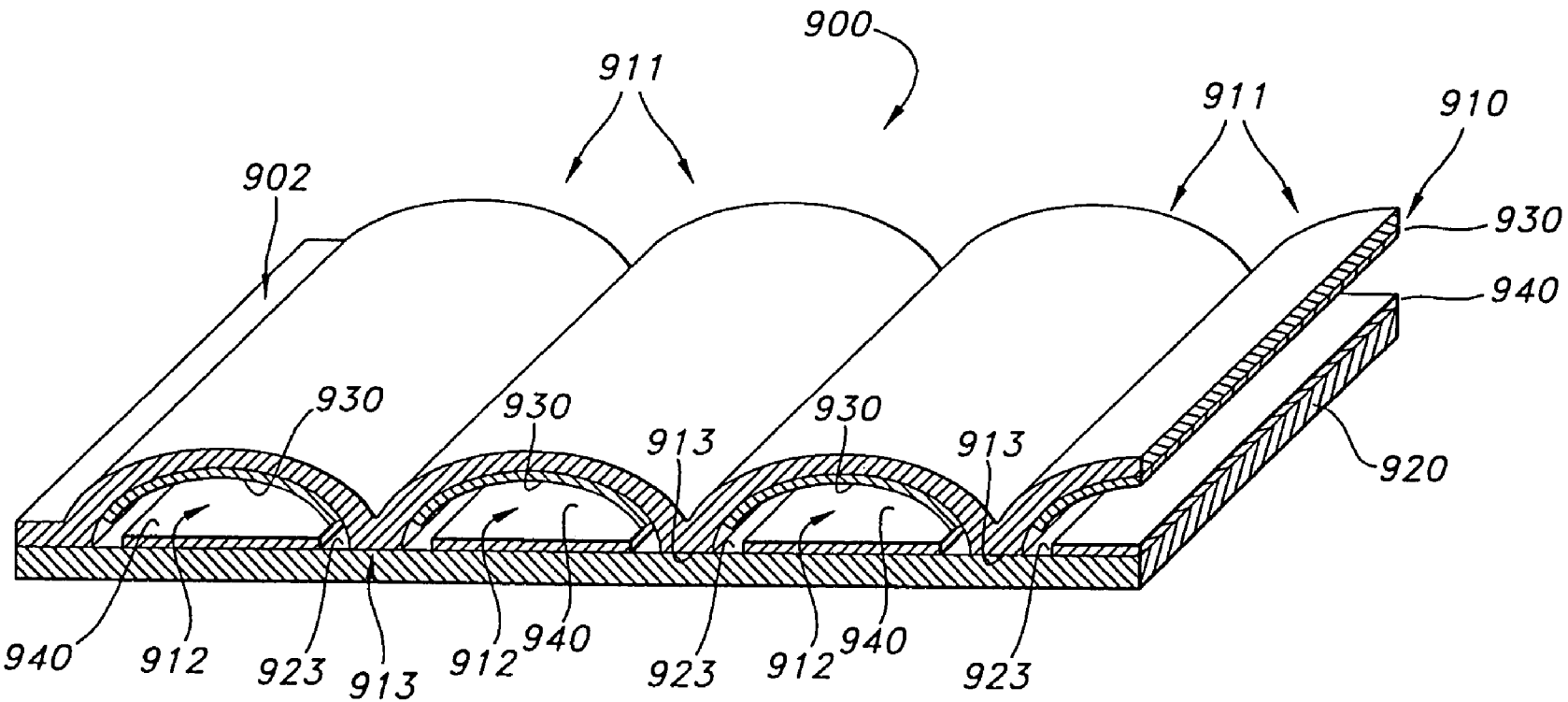
FIG. 13 is a cut-away sectional view of a mat switch embodiment of the invention; and, FIGS. 14A and 14B are plan views of a top cover and base, respectively, of the mat switch embodiment of FIG. 13.
Figure 14B:
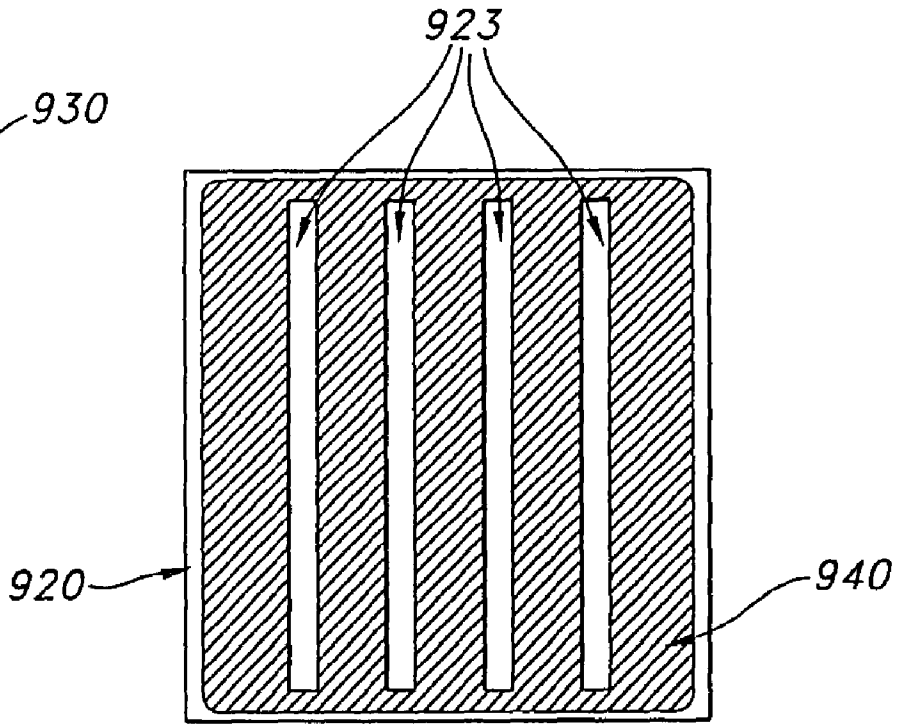
Figure 14A:
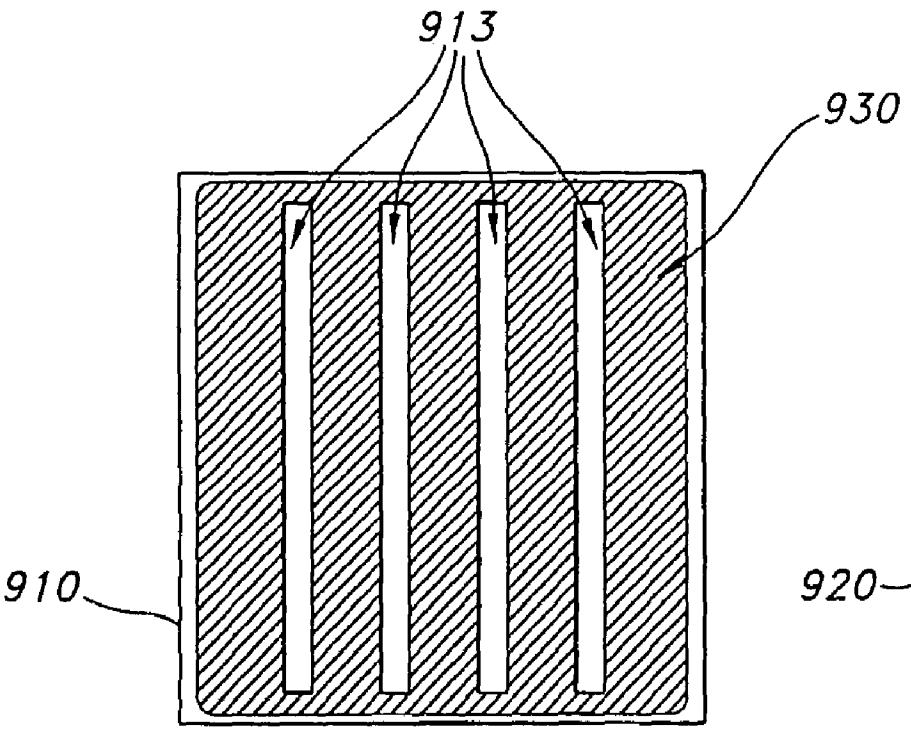

Referring now to FIGS. 13, 14A and 14B, a mat sensor 900 includes a housing having a top cover 910 with a conductive electrode coating 930 disposed on the lower surface thereof, and a base 920 with a conductive electrode coating 940 disposed on an upper surface thereof so as to be in opposing relation to the conductive electrode coating 930 on the top cover. The top cover 910 is corrugated so as to form a plurality of elongated parallel cells 912.

Referring particularly now to FIGS. 14A and 14B, which show the top cover 910 and base 940 in a pre-assembled state, the conductive electrode coating 930 disposed on top cover 910 includes parallel linear void areas 913 without any conductive coating. Likewise, the conductive electrode coating 940 disposed on base 920 includes parallel linear void areas 923 without any conductive electrode coating. Both the top cover 910 and the base 920 are preferably fabricated from green rubber. The conductive electrode coating is preferably also a green rubber based composition as described above, and can optionally be a foam rubber.

In a method for making mat switch 900 the conductive electrode coatings 930 and 940 are deposited on the top cover 910 and base 920, respectively, by any suitable technique, such as described above. Masks may be employed to provide for the void areas 913 and 923. The top cover 910 is formed into a corrugated configuration and positioned in conjunction with the base 920 such that the void areas 913 are aligned with and in contact with the void areas 923. The void areas 913 and 923 are non conductive and prevent a short circuit path from forming when the top cover 910 and base 920 are assembled. The top cover 910 and the base 920 are compression merged together. The top cover 910 and base 920 are then vulcanized such that the areas of contact between the void areas 913 and 923 form seals. A peripheral seal 902 can be formed around the edge of the mat switch 900.

As can be seen from FIG. 13, within each cell 912 the upper conductive electrode coating 913 and the lower conductive electrode coating 940 are spaced apart from each other. When mechanical pressure is applied on the mat switch 900, top cover 910 resiliently bends against to permit contact between the upper conductive electrode coating 913 and the lower conductive electrode coating 923 so as to close an electric circuit. Electrical leads are attached to the respective upper and lower electrode coatings 913 and 923 by any suitable means. The leads can be used to incorporate the mat switch 900 into an electric circuit, for example, to control the opening or closing of mechanical doors, the operation of machinery, the sounding of alarms, etc.

Figure 15:
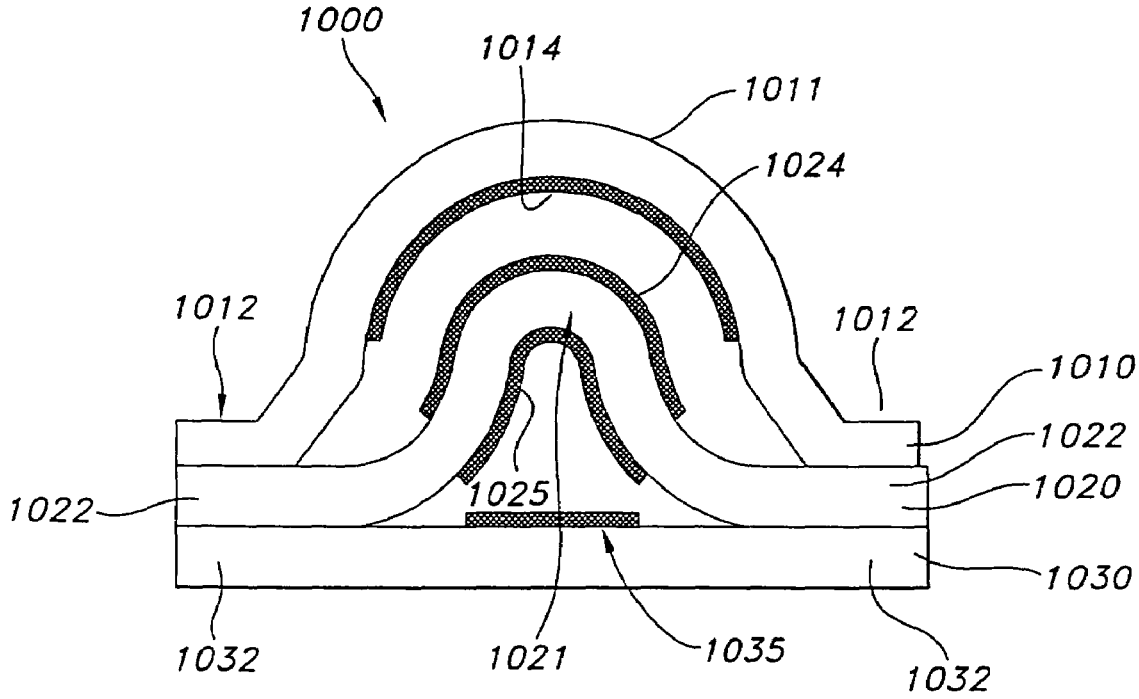
FIG. 15 is an illustration of another alternative embodiment of the assembled tubular sensor with sensitizing middle portion.
Figure 16:
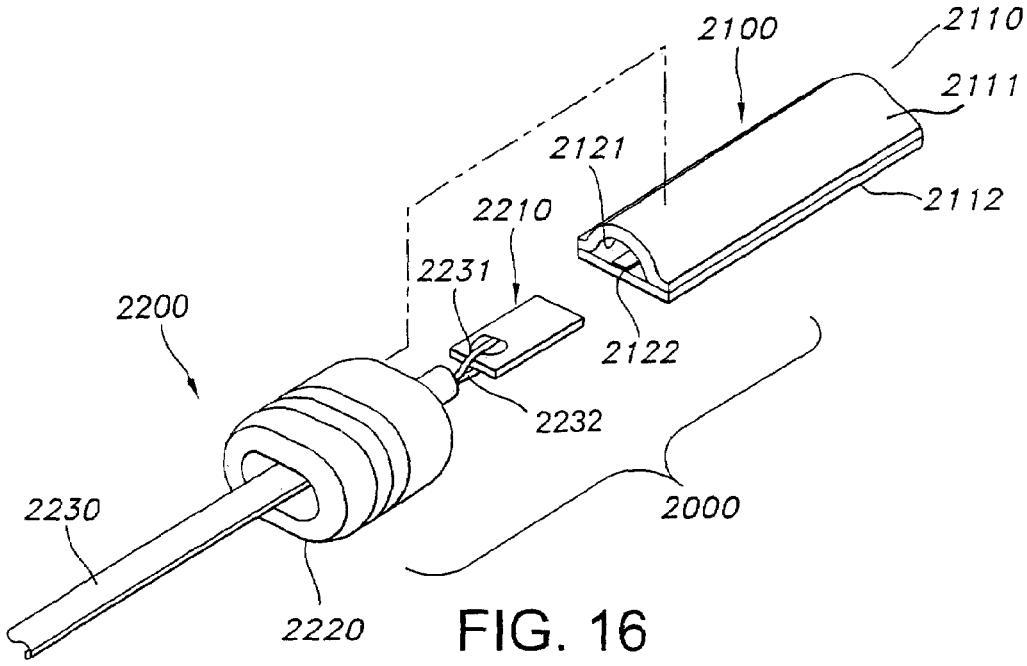
FIG. 16 is an exploded perspective view of a tubular sensor switch assembly with a terminal plug connection.
Figure 18:
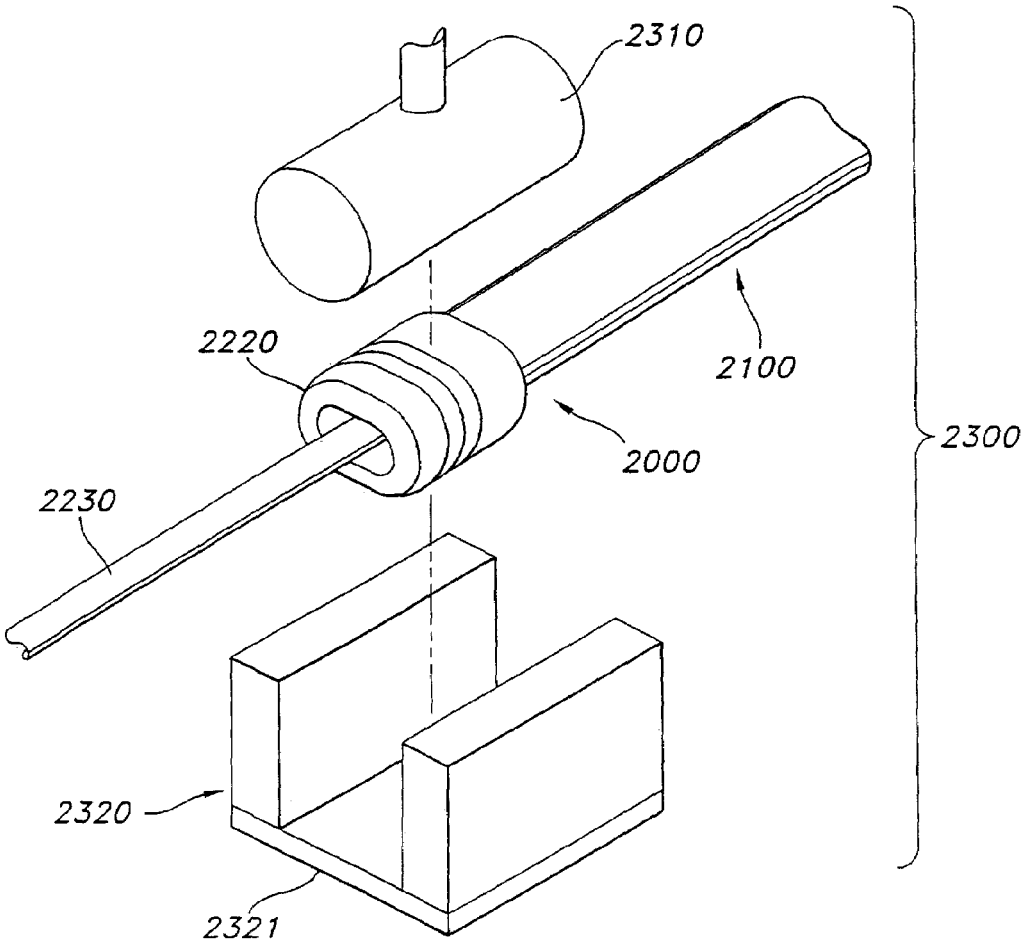
FIG. 18 is an exploded perspective view illustrating the placement of the end portion of the tubular switch assembly with the terminal plug in a ferrule crimping apparatus.

Referring now to FIG. 15, a two-stage elongated tubular sensor type pressure actuated switching device 1000 is illustrated wherein the housing includes a cover substrate 1010, a middle electrode element 1020 and a base substrate 1030. Cover substrate 1010 includes a curved upper portion 1011 and a lateral flange portions 1012 extending along each of two opposite sides of the device 1000. A conductive electrode coating 1014 is deposited on the interior surface of the cover substrate at the curved upper portion 1011.

Conductive electrode coatings 1024 and 1025 are disposed along the top side and bottom sides, respectively of the middle electrode element 1020. The middle electrode element 1020 includes a curved upper portion 1021 and flange portions 1022 extending along each of two opposite sides of the device 1000. Conductive electrode coating 1024 and 1025 are deposited on the upper and inner surfaces of the curved upper portion 1021. The base substrate 1030 is an elongated flat member having a conductive electrode coating 1035 longitudinally applied to a middle portion of the upper surface.

To assemble pressure actuated switching device 1000, the middle electrode element 1020 and base substrate 1030 are pinched merged along the flange portions 1022 and edge portions 1-32 of the base 1030.

Then the cover substrate is positioned in aligned relationship to the middle electrode 1020 and flange portions 1012 are pinch merged to flange portions 1022. Because of the use of green rubber, merging the rubber flange areas together with subsequent vulcanization produces a chemically linked bond and fluid impervious seal along the joined areas.

Cover pressure applied to the top surface of the cover substrate 1010 causes the cover substrate to resiliently deform so as to bring the upper conductive electrode coating 1014 into contact with upper conductive electrode coating 1024 of the middle electrode element 1020, thereby making electrical contact and closing the first switch. Further pressure of the cover 1010 causes distortion of the middle electrode element so as to bring the inner conductive electrode coating 1025 into contact with the base conductive electrode 1035, thereby making electrical contact and closing the second switch.

Referring now to FIGS. 16-22, a system and ferrule-clamp method for connecting terminal leads to a pressure actuated tubular sensor are illustrated. It should be remembered that while specifics of the system and method are provided below for illustrative purposes one skilled in the art will envision other variations within the scope of the invention. More specifically referring to FIG. 16, a tubular sensor switch assembly 2000 includes a tubular sensor portion 2100 and a terminal plug assembly 2200 joined thereto. The tubular sensor portion 2100 includes a resiliently deformable housing 2110 having first and second layers 2111 and 2112, respectively, which are joined at the lengthwise peripheral edges of the tubular sensor portion 2100. A first conductive electrode film 2121 is disposed lengthwise along the inner surface of the first layer 2111 of the housing 2110. A second conductive electrode film 2122 is disposed along the inner surface of the second layer 2112 of the housing 2110 in facing relation to the first conductive electrode film 2121. The first and second conductive electrode films 2121 and 2122 are biased to a spaced apart relation to each other, but are movable to a position wherein they are in electrical contact with each other when a force of sufficient magnitude is applied to housing 2100 so as to overcome the biasing force of the resilient housing 2100, thereby causing it to collapse. The housing 2100 can be fabricated from any suitable resilient material, especially natural or synthetic rubbers. Preferably the housing 2100 is fabricated from green rubber in accordance with the methodology described above herein. When the first and second conductive electrode films 2121 and 2122 are in contact, the tubular sensor 2000 is in a "closed switch" configuration so as to conduct an electric current. As part of an electrical circuit the tubular sensor portion 2100 can perform the function of machinery control, detection of obstacles in the path of moving objects, etc., as described above. The terminal plug assembly 2200 enables the tubular sensor switch assembly 2000 to be incorporated into an electrical circuit.

Figure 17A:
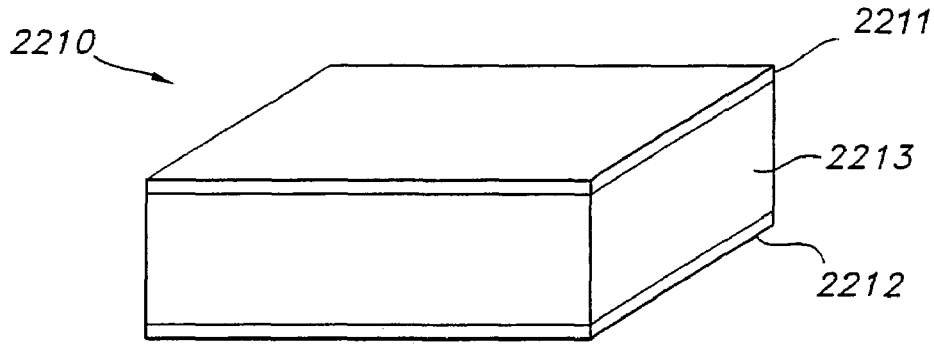
FIG. 17A is a perspective view of a contact plate for securing electrical connection between the conductive electrode films of the tubular sensor portion of the sensor assembly an a cable for electrically connecting the tubular switch assembly to an electrical circuit.

The terminal plug assembly 2200 includes a contact plate 2210, ferrule 2220 and cable 2230. Referring also now to FIG. 17A the contact plate 2210 includes an insulative body 2213 having first and second conductive contact electrodes 2211 and 2212, respectively, on opposite respective sides of the body 2213. The body 2213 can be rigid or flexible and can be fabricated from, for example, phenolic resin, glass filed epoxy, expanded cellular polymer, PVC, natural or synthetic rubber such as silicone rubber, and the like. The conductive electrodes 2211 and 2212 can be films of metal such as copper, nickel, silver, and the like, metal foils, or metal sheets laminated to the body 2213. For example, the contact plate can be fabricated from a printed circuit board with double sided copper plating.

Again referring to FIGS. 16 and 18, the cable 2230 provides electrical wire leads for incorporating the tubular sensor switch assembly 2000 into an electrical circuit. Cable 2230 includes first and second wires leads 2231 and 2232 which are electrically connected through contact plate 2210 to the first and second contact electrodes 2211 and 2212, respectively. When the embodiment of the contact plate 2210 is employed wire leads 2231 and 2232 are each contacted with an opposite side of the contact plate 2210. However, it is possible for both wire leads 2231 and 2232 to be contacted with the same side of the contact plate.

Figure 17B:
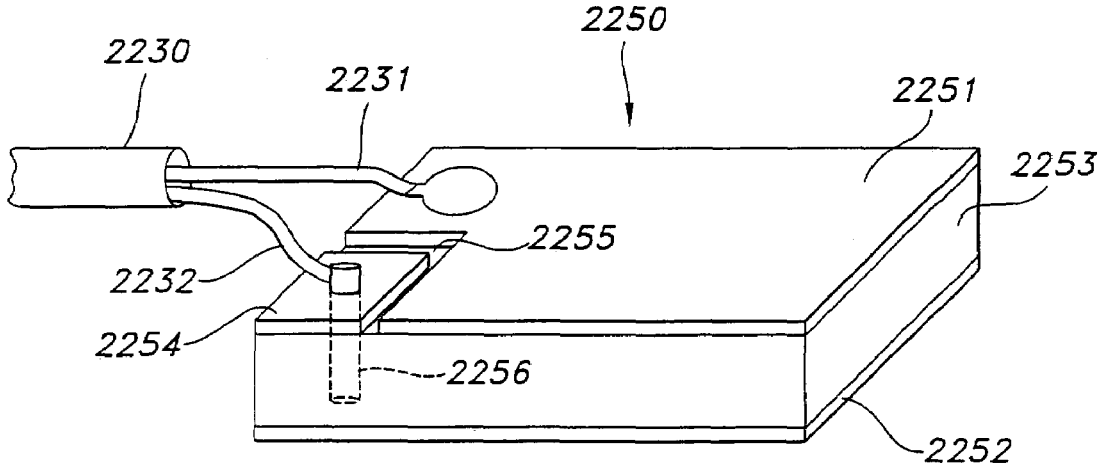
FIG. 17B is a perspective view of an alternative embodiment of the contact plate enabling same-side connection of the cable wire leads to the contact plate.
Figure 19:
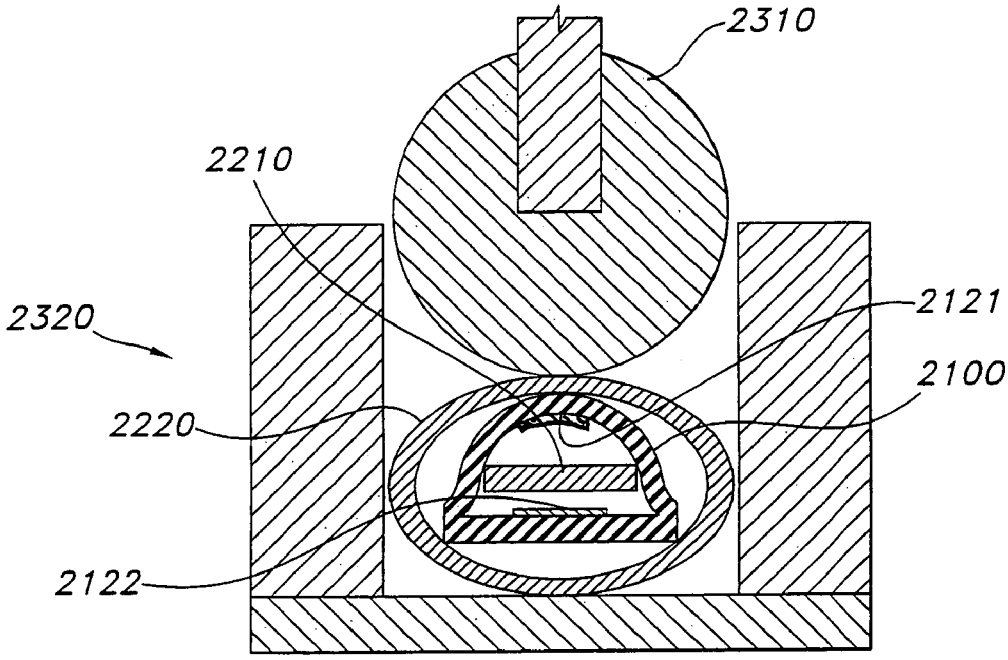
FIGS. 19 and 20 are, respectively, end and side elevational views showing placement of the end portion of the tubular switch assembly in the crimping apparatus prior to execution of the crimping operation; and, FIGS. 21 and 22 are, respectively, end and side elevational views showing the crimped end portion of the tubular switch assembly in the crimping apparatus.
Figure 20:
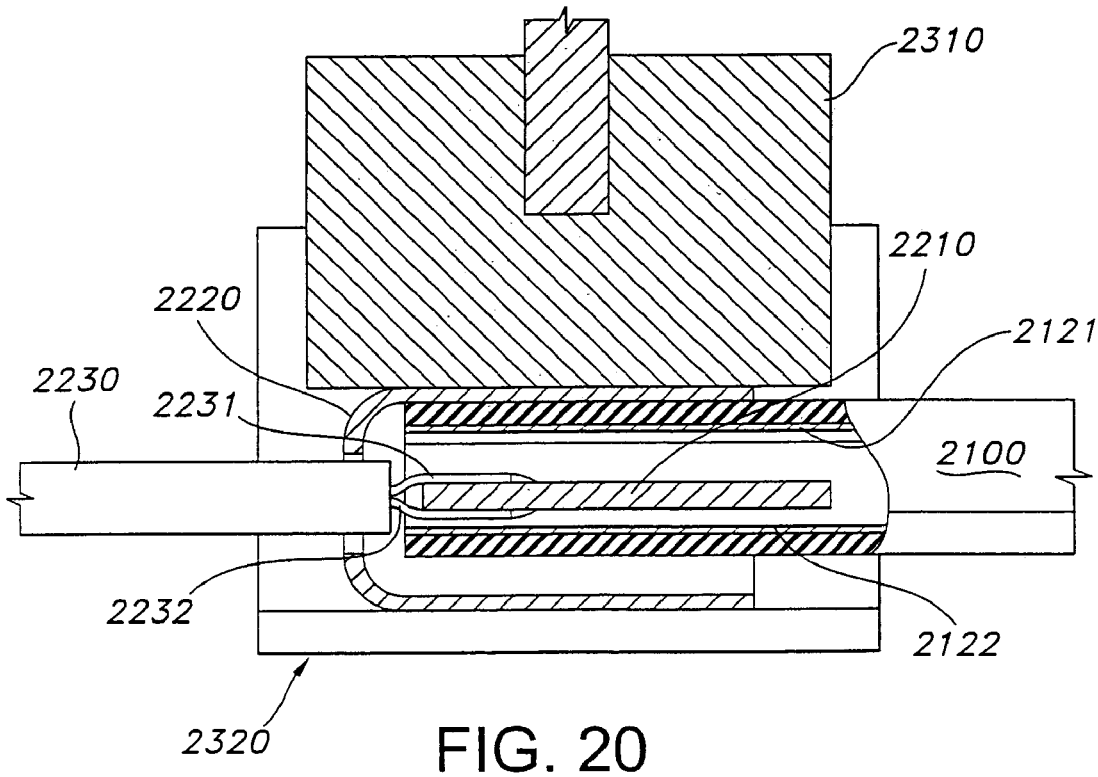

For example, referring to FIG. 17B, a contact plate 2250 includes an insulative body 2253 having a first contact electrode 2251 on one side of the body and a second contact electrode 2252 on the opposite side of body 2253. A third contact electrode 2254 is disposed on a portion of the same side of body 2253 as the first contact electrode 2251, but is electrically separated and physically spaced apart from first contact electrode 2251 by a gap 2255 so as to prevent the flow of electric current between the first and third contact electrodes.

A through-hole, or via 2256, extends through body 2253 form the third contact electrode 2254 to the second contact electrode 2252. The via 2256 can be clad with copper or other conductive metal, or can be occupied by a conductive plug made from metal (copper, silver, gold, etc.) Or other conductive material so as to establish electrical contact between the third contact electrode 2254 and the second contact electrode 2252.

Using contact plate 2250, wire leads 2231 and 2232 of cable 2230 can be respectively secured to the first contact electrode 2251 and the third contact electrode 2254 on the same side of contact plate 2250 without creating a short circuit. It is preferable to apply electrical insulation to cover the third contact electrode 2254, gap 2255, and the contact region where the second wire lead 2232 connects to it after the connection is made to prevent unintended short circuiting by, for example, an accidental bridging of gap 2255 by a conductive member.

Ferrule 2220 is a band of malleable material such as metal or plastic which can be deformed under mechanical pressure into a crimped configuration for sealing the end of the tubular sensor switch assembly 2000.

Referring now to FIGS. 16, 18, 19 and 20, the terminal plug assembly 2200 is joined to the tubular sensor portion 2100 by inserting the contact plate (already connected to cable 2230) into the end of the tubular sensor portion 2100 in the space between the first layer 2111 and second layer 2112 of the housing 2110. The ferrule 2220 is positioned around the end portion of the tubular sensor portion 2100 so as to seal the end portion when crimped.

The end portion of the tubular switch assembly 2000 is placed in a crimping apparatus 2300, which includes a forming rod 2310 and a containment vise 2320. More particularly, the containment vise 2320 includes a generally U-shaped frame. The end portion of the tubular switch assembly 2000 including the ferrule 2200 is positioned within the walls of U-shaped frame 2321 and secured therein.

Figure 21:
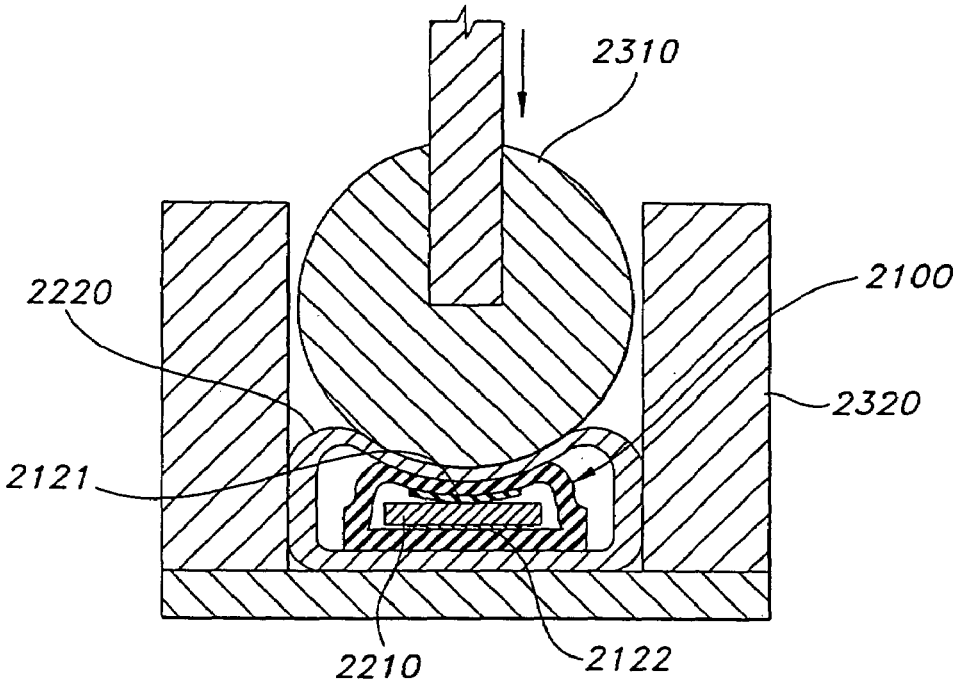
Figure 22:
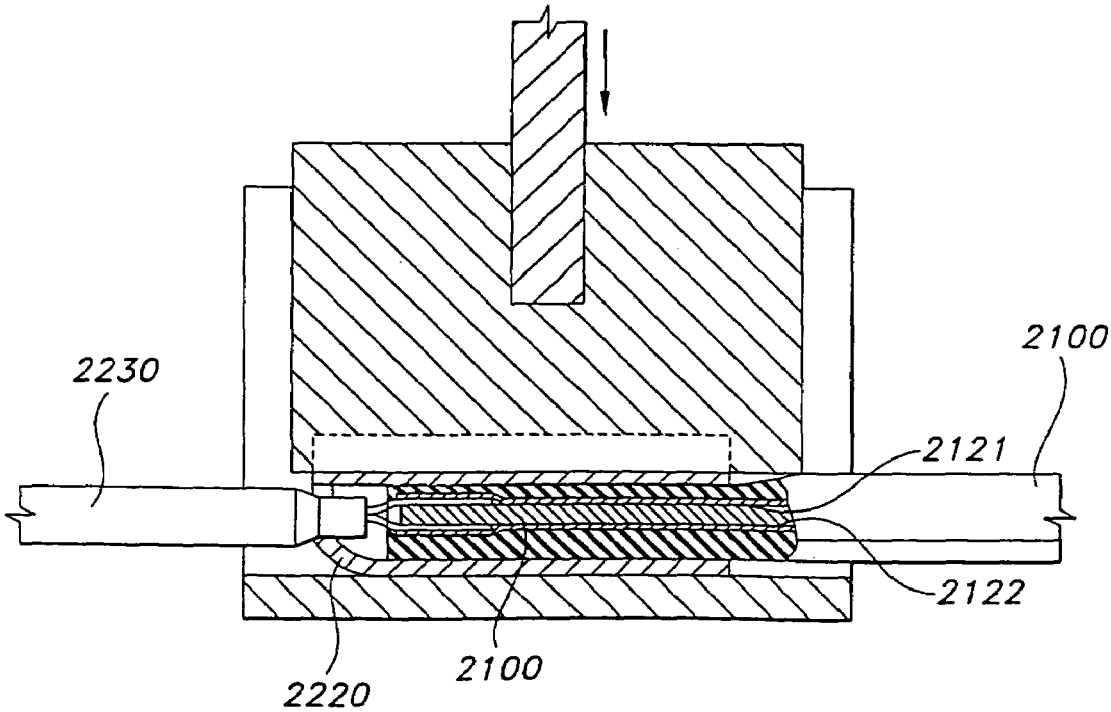

Referring also now to FIGS. 21 and 22, the forming rod 2310 is brought down upon the ferrule 2200 with sufficient force so as to crimp the ferrule 2200 sufficiently to form a hermetic seal of the end of the tubular sensor portion 2100.

Also, the crimping of the ferrule 2200 simultaneously collapses the end of the tubular sensor portion 2100 thereby bringing into electrical contact (1) the first conductive electrode film 2121 on the inside surface of the first layer 2111 of the housing with the first contact electrode 2211 of the contact plate and (2) the second conductive electrode film 2122 on the inside surface of the second layer 2112 of the housing with the second contact electrode 2212 of the contact plate. Accordingly, securing the electrical connection between the terminal plug assembly 2200 and the tubular sensor portion 2100 and sealing the end of the tubular sensor portion 2100 are both accomplished with a single operation.

The opposite end of the tubular sensor portion 2100 may be sealed with a non-electrical plug using the crimped ferrule method described herein to prevent entry of moisture, debris, or other unwanted matter into the interior of the sensor.

While all of the above description contains many specifics, these specifics should not be construed as limitations on the scope of the invention, but merely as exemplifications of preferred embodiments thereof. Those skilled in the art will envision many other possibilities within the scope and spirit of the invention as defined by the claims appended hereto.

What is claimed is:

1. A pressure actuated switching device which comprises:

a) a housing fabricated from a non-conductive elastomeric polymer;

b) at least two separate conductive electrode layers fixedly attached to the housing and positioned in spaced apart opposing relationship to each other, at least one of the conductive electrode layers being fabricated from a composition containing the elastomeric polymer and a conductive particulate filler, wherein said at least one conductive electrode layer is bonded by chemical cross links to the housing, wherein the housing comprises a flat base and a corrugated top cover joined to the flat base so as to form a plurality of elongated parallel cells.

2. A pressure actuated switching device which comprises:

a) a housing fabricated from a non-conductive elastomeric polymer;

b) at least two separate conductive electrode layers fixedly attached to the housing and positioned in spaced apart opposing relationship to each other, at least one of the conductive electrode layers being fabricated from a composition containing the elastomeric polymer and a conductive particulate filler, wherein said at least one conductive electrode layer is bonded by chemical cross links to the housing, wherein the housing comprises an elongated upper portion and an elongated base, the upper portion having opposite lengthwise edges configured to engage corresponding lengthwise slots in the base, the base comprising an upwardly projecting ridge wherein one said conductive electrode layer is chemically bonded by cross linking to an upper surface of the ridge and the other of said conductive electrode layers is chemically bonded to a lower surface of the upper portion.

3. The pressure actuated switching device of claim 2 wherein the upper portion has an arcuate cross section and the upper surface of the ridge is arcuate.

4. The pressure actuated switching device of claim 2 wherein the upper portion includes at least one outwardly projecting lengthwise extending protrusion.

5. The pressure actuated switching device of claim 4 wherein the upper portion includes at least three outwardly projecting lengthwise extending protrusions.

6. A pressure actuated switching device which comprises:

a) a housing fabricated from a non-conductive elastomeric polymer;

b) at least two separate conductive electrode layers fixedly attached to the housing and positioned in spaced apart opposing relationship to each other, at least one of the conductive electrode layers being fabricated from a composition containing the elastomeric polymer and a conductive particulate filler, wherein said at least one conductive electrode layer is bonded by chemical cross links to the housing, wherein the housing comprises an elongated single piece member folded along a lengthwise bend to define an upper portion and a base portion, wherein one of said conductive electrode layers is chemically bonded by cross linking to the upper portion and the other of said conductive electrode layers is chemically bonded by cross linking to the base portion.

7. A pressure actuated switching device which comprises:

a) a housing fabricated from a non-conductive elastomeric polymer;

b) at least two separate conductive electrode layers fixedly attached to the housing and positioned in spaced apart opposing relationship to each other, at least one of the conductive electrode layers being fabricated from a composition containing the elastomeric polymer and a conductive particulate filler, wherein said at least one conductive electrode layer is bonded by chemical cross links to the housing, wherein the housing includes a lengthwise extending outer cover configured to form a tubular portion and a flange, wherein the two conductive electrode layers are disposed opposite each other along an inside surface of the tubular portion and are chemically bonded by cross linking thereto, and the flange comprises two walls of the outer cover bonded to each other along a common interface.

8. A pressure actuated switching device which comprises:

a) a housing fabricated from a non-conductive elastomeric polymer;

b) at least two separate conductive electrode layers fixedly attached to the housing and positioned in spaced apart opposing relationship to each other, at least one of the conductive electrode layers being fabricated from a composition containing the elastomeric polymer and a conductive particulate filler, wherein said at least one conductive electrode layer is bonded by chemical cross links to the housing, wherein the housing includes a lengthwise extending outer cover configured to form a tubular portion having an inner surface defining a bore and first and second flange-forming walls, and a second member having a flange portion and an end portion extending into the bore of the tubular portion, wherein the flange portion of the second member is disposed between the first and second flange-forming walls of the outer cover so as to form a first interface between the first flange-forming wall and a first side surface of the flange portion and a second interface between the second flange-forming wall and a second side surface of the flange portion, wherein one conductive electrode layer is bonded by chemical cross linking to the outer cover and extends along the first interface and along the inner surface of the tubular portion, and the other of the conductive electrode layers is chemically bonded by cross linking to the second member and extends along the second interface and around the end portion of the second member.

9. A pressure actuated switching device which comprises:

a) a housing fabricated from a non-conductive elastomeric polymer;

b) at least two separate conductive electrode layers fixedly attached to the housing and positioned in spaced apart opposing relationship to each other, at least one of the conductive electrode layers being fabricated from a composition containing the elastomeric polymer and a conductive particulate filler, wherein said at least one conductive electrode layer is bonded by chemical cross links to the housing wherein the housing includes a lengthwise extending outer cover configured to form a tubular portion having an inner surface defining a bore and first and second flange-forming walls, and a second member disposed between the first and second flange-forming walls of the outer cover so as to form a first interface between the first flange-forming wall and a first side surface of the second member and a second interface between the second flange-forming wall and a second side surface of the second member, wherein one conductive electrode layer is bonded by chemical cross linking to the outer cover and extends along the first interface and along a first portion of an inside surface of the bore of the tubular portion, and the other conductive electrode layer is bonded by chemical cross linking to the outer cover and extends along the second interface and along a second portion of the inside surface of the bore of the tubular portion, wherein the conductive electrode layers have a crenelate shaped edge.

10. A pressure actuated switching device which comprises:

a) a housing fabricated from a non-conductive elastomeric polymer;

b) at least two separate conductive electrode layers fixedly attached to the housing and positioned in spaced apart opposing relationship to each other, at least one of the conductive electrode layers being fabricated from a composition containing the elastomeric polymer and a conductive particulate filler, wherein said at least one conductive electrode layer is bonded by chemical cross links to the housing, wherein the housing comprises an elongated flat base and an elongated upper portion having an arcuate cross-section, and wherein a first conductive electrode layer is bonded by chemical cross links to an upper surface of the base and a second conductive electrode layer is bonded by chemical cross links to lower surface of the elongated upper portion of the housing, and further comprising an elongated member having an arcuate cross section disposed between the base and the upper portion of the housing, said elongated member having an upper surface and a lower surface, wherein a third conductive electrode layer is bonded by chemical cross links to the upper surface of the elongated member and a fourth conductive electrode layer is bonded by chemical cross links to the lower surface of the elongated member.

* * * * *